US007513480B2

(12) United States Patent
Bergaretxe et al.

(10) Patent No.: US 7,513,480 B2
(45) Date of Patent: Apr. 7, 2009

(54) CLIMBING SYSTEM FOR SHUTTERING, SCAFFOLDING AND LOADS IN GENERAL

(75) Inventors: Alberto Arozena Bergaretxe, Guipuzcoa (ES); Iñaki Irizar Moyua, Guipuzcoa (ES)

(73) Assignee: Ulma C Y E, S. Coop, Onati (ES)

( * ) Notice: Subject to any disclaimer, the term of this patent is extended or adjusted under 35 U.S.C. 154(b) by 228 days.

(21) Appl. No.: 10/581,129

(22) PCT Filed: Nov. 27, 2003

(86) PCT No.: PCT/ES03/00605

§ 371 (c)(1),
(2), (4) Date: May 30, 2006

(87) PCT Pub. No.: WO2005/054604

PCT Pub. Date: Jun. 16, 2005

(65) Prior Publication Data

US 2007/0119116 A1 May 31, 2007

(51) Int. Cl.
*E04G 11/28* (2006.01)
*B28B 11/24* (2006.01)

(52) U.S. Cl. ..... 249/20; 425/65

(58) Field of Classification Search ..... 249/19–22, 249/26, 192; 425/63–65; 182/36, 82, 136
See application file for complete search history.

(56) References Cited

U.S. PATENT DOCUMENTS 3,593,392 A * 7/1971 Lambertini ..... 425/63
3,779,678 A * 12/1973 Scheller ..... 425/65
4,147,483 A 4/1979 Rovera
4,611,784 A * 9/1986 Gallis ..... 249/20
5,630,482 A * 5/1997 Schw orer ..... 182/82
6,276,912 B1 8/2001 Röck
6,530,552 B2 * 3/2003 Bergaretxe ..... 249/4
2002/0121586 A1 * 9/2002 Gates ..... 249/45
2003/0052249 A1 3/2003 Waldschmitt

FOREIGN PATENT DOCUMENTS

| | | |
|---|---|---|
| EP | 0155217 | 9/1985 |
| EP | 0373617 | 12/1989 |
| EP | 0681635 | 1/1994 |
| GB | 2021672 | 12/1979 |

* cited by examiner

*Primary Examiner*—Steven P Griffin
*Assistant Examiner*—Seyed Masoud Malekzadeh
(74) *Attorney, Agent, or Firm*—Knobbe, Martens, Olson & Bear, LLP

(57) ABSTRACT

The climbing system comprises an upper head (5) attached to the bracket arrangement (3) and also solidly joined to the body of a hydraulic cylinder (6) the rod whereof is attached to a lower head (7), both heads (5) and (7) having a body (8) with upper (9) and lower (10) wings defining there between guides that encircle the upright (1), each of the heads having a rocker (11) that can act on flanges or blocks (14) distributed along the upright (1). The rocker is mounted on a transversal axis (12), against the action of a spring (13) that permanently acts on the rocker in any of its operating positions, and there is an outer handle (19) solidly joined to the transversal axis (12), which can make said axis (12) rotate to change the position of the rocker in relation to the upright (1). The system also has a safety device that makes it possible to limit the positions of the rocker.

6 Claims, 22 Drawing Sheets

CLIMBING SYSTEM FOR SHUTTERING, SCAFFOLDING AND LOADS IN GENERAL

OBJECT OF THE INVENTION

The present invention relates to a climbing system for raising shuttering panels from one section of a wall towards a higher section in order to continue the shuttering work on that new section for the subsequent concreting thereof, with the additional possibility of using the system to raise scaffolding or displace loads in general, both vertically and horizontally.

The climbing system is of the type that includes an upright or guide rail that can move up the wall and a bracket arrangement, whereto the shuttering is solidly joined, which is moveable in relation to the upright, with the particularity that neither of these two elements is fixed to the ground.

The bracket arrangement and the upright are attached by climbing heads, which are joined by a hydraulic cylinder and which have rockers that push on flanges defined in the upright or rest on said flanges, thus raising the upright in relation to the wall or raising the bracket arrangement in relation to the upright, respectively.

It is the object of the invention that each of the heads incorporates a handle that changes the position of the rockers depending on the working phase of the system, i.e. to raise the upright, raise the bracket arrangement or for subsequent concreting, thus aiding and simplifying the action of the system.

Another object of the invention is a safety mechanism that prevents the heads from accidentally changing from one operating position to another.

BACKGROUND OF THE INVENTION

Patent of Invention U.S. Pat. No. 6,276,912 relates to a "Climbing shuttering system for successive concreting of high vertical walls", which basically consists of a horizontal support structure from which a plurality of vertical beams are appended with shuttering panels for concreting connected thereto in parallel. The beams rest on a horizontal platform that moves vertically due to the action of a hydraulic cylinder, in such a way that once the walls at one height have been cast the platform is raised, thereby also raising the vertical beams and the shuttering panels to cast the walls at another height. To fix the position of the platform at a particular height the system uses articulated pawls that rest on notches that must be made in the concreted walls or pillars, which must get higher as the shuttering progresses. The platforms are raised from one section of shuttering to the next in one operation, i.e. by means of a single stroke of the cylinder.

Patent of Invention U.S. Pat. No. 4,147,483 also discloses "Climbing shuttering for casting concrete structures such as dams or retaining walls", which has a structure attached to a shuttering panel that climbs up the already concreted wall driven by the action of a hydraulic cylinder, the base whereof is attached to a triangular structure, which, due to the action of an actuator, can be separated from the wall to then ascend until it is anchored to anchoring points situated at a higher level. This means that the wall must have a means of anchoring to enable the anchoring and forward movement of the triangular structure along the wall.

British Patent no. 2021672 relates to climbing shuttering that requires uprights or support profiles that are fixed to the ground, which must present the total height to be shuttered, with sliding heads mounted thereon whereto a support or bracket arrangement is fixed with the shuttering elements attached thereto, in such a way that the heads, and therefore also the shuttering elements, can be displaced vertically in relation to the support profiles fixed to the ground.

Specifically, the system uses an upper head and a lower head that have pulleys that slide on the upright and a pivoted latch arm that can rest and press on flanges or blocks provided at fixed intervals along the surface of the upright. The system also incorporates an intermediate head that is joined to the upper head by means of a hydraulic cylinder, which raises the upper head as it extends and with it raises the whole shuttering structure, while the system uses the intermediate head to rest on the blocks or flanges on the upright.

In this system, the bracket arrangement rises in relation to the upright but the upright remains fixed to the ground.

Patent of Invention EP0373617 relates to a "Displaceable platform movable sectionwise on a wall", which has a means of anchoring to the wall and carrier rails separated from the wall on which the bracket arrangement moves, serving as a base for a platform on which the shuttering rests. The system incorporates a drive mechanism to determine, on the one hand, the vertical movement of the carrier rails, and on the other hand, to raise the platform and therefore also the shuttering in relation to the carrier rails, all of which uses the wall as a base without resting on the ground.

Specifically, the device includes two slide shoes, attached to one another by a double-acting hydraulic cylinder. The shoes can slide in relation to the carrier rails, having for this purpose bent pivoted levers that have transversal spigots at the ends, which are housed in a toothed displacement rack on the carrier rail and which work their way stepwise up the toothed displacement rack due to the action of the hydraulic cylinder. In this system, the upright and the bracket arrangement are raised alternately but the mechanisms that enable this are very complex.

European Patent no. 0681635 relates to a self-climbing device also comprising an upright that can ascend vertically in relation to the wall to be cast and a bracket arrangement that supports the shuttering elements, which can, in turn, slide in relation to the upright.

The bracket arrangement is attached to the upright by means of two heads, an upper and a lower head, which are joined to each other by a hydraulic cylinder. Each head includes a rotating rocker or locking element that either rests against the flanges provided in the upright to raise the bracket arrangement or pushes the upright upwards by means of said flanges.

For the rocker to work in the different phases involved in raising the shuttering, each of the heads includes a rotating control member that is mounted on the same axis as the rocker and control cams provided along the length of the upright, alternating with the flanges thereof, to act on the control member.

In this manner, the control cams act on the control member engaging it with the locking member or rocker, in such a way that in one direction of movement, the control cam makes the locking member rotate so that it comes into contact with one of the flanges on the upright, whilst in the other direction it allows a certain tilting motion of the rocker to pass the flanges on the upright, without having to apply any force.

The control cams have two active faces, depending on whether the heads are moving up or down and, consequently, the control members of the heads also have two active arms that act in each direction of movement.

Of course, there are means of locking the control members and the locking members of each head in order to allow the necessary movement of the rocker in each of the upward phases involved in raising the shuttering.

DESCRIPTION OF THE INVENTION

The object of the invention is a climbing system that is easy and simple to use in any of the working phases thereof, also including a measure to prevent the system from accidentally passing from one mode of operation to another.

The climbing system is of the type that is based on the use of an upright that moves in relation to the wall to be cast, and a bracket arrangement that, in turn, moves in relation to the upright, the upright having a plurality of flanges or blocks that serve as support and transmit impetus for the devices that enable the movement of the upright and the bracket arrangement.

The system is of the type that includes two climbing heads, an upper and a lower head, joined by means of a hydraulic cylinder that slides along the upright, the upper climbing head being permanently joined to the bracket arrangement that supports the shuttering panels.

The heads comprise a body with upper and lower wings that encircle the profile of the upright relative to which they longitudinally slide, the upper head being attached by its lower end to the body of the hydraulic cylinder, whilst the lower head is attached to the rod of said cylinder.

According to the object of the invention, the heads include a handle that is solidly joined to the transversal axis whereon the rocker is mounted, said handle having the possibility of three different operating positions that cause the rocker to rotate according to the phase of raising the shuttering that is to be performed, it being anticipated that a compression spring be included to press against the rocker at all times in order to maintain its operating position whilst allowing the rocker to tilt slightly.

The rocker has a practically triangular form and its two vertices situated on the same inclined plane are bevelled to define an upper face and an upper front face, at 90°, on one of the vertices, and a lower face and a lower front face, at 90°, on the other vertex.

The upper and lower faces will constitute the active faces of the rocker as they are the faces that transmit the stresses, either by pushing the upright, by means of flanges thereon, in the phase whereby the upright is raised, or by resting thereon, by means of one of its flanges, in the phase whereby the bracket arrangement is raised, whilst the front faces remain in contact with the surface of the upright, thereby preventing the rotation of the rocker in the positions of force thereof and maintaining the operating position of the head.

However, when the inclined plane of the rockers is in contact with one of the flanges on the upright during its upward or downward movement, it can tilt slightly, compressing the spring in such a way that once the position of the flange has been passed the spring forces the rocker to resume its position.

Specifically, the rocker can occupy three different positions that must always be achieved by changing the position of the handle, these being:

Neutral position. In this position the inclined plane of the rockers is parallel to the upright without resting on the flanges on the upright, corresponding to the situation wherein the upright and the bracket arrangement have already been raised and the concreting work is to be performed. This position also prevents the raising mechanisms from accidentally moving the upright or the bracket arrangement.

Position for raising the upright. The upper face of the two rockers is in a horizontal position, the upper face of one of the rockers constituting the surface that pushes a flange on the upright upwards to aid the raising of the upright due to the action of the cylinder, whilst on the descent of one of the heads the rocker, as its inclined plane comes into contact with a flange on the upright, tilts slightly, loading the compression spring which, once the flange has been passed, forces the rocker to resume its working position.

Position for raising the bracket arrangement. The lower face of the two rockers is in a horizontal position, the lower face of one of the rockers constituting the surface that rests on a flange on the upright to help raise of the bracket arrangement due to the action of the cylinder, whilst on the ascent of one of the heads the rocker, as its inclined plane comes into contact with a flange on the upright, tilts slightly, loading the compression spring which forces the rocker to resume its working position once the flange has been passed.

To limit the movement of the rocker as it tilts in each of the aforesaid operating positions a safety device is used, which comprises a spring positioner that is housed, depending on the operating position of the handle and the rocker, in holes defined in an outer cover of the head, to interact with an inner disc that is mounted on the axis of the rocker and therefore moves with the movement of the rocker. The inner disc has a peripheral notch that defines a groove inside which the spring positioner is housed and acts, in such a way that as the rocker tilts the spring positioner will come into contact with one of the ends of said groove, thus limiting its tilting movement.

Three holes have been provided for the insertion of the positioner, which define the limit of tilting movement of the rocker in each of the operating positions thereof and, specifically, an upper hole that limits the tilting movement of the rocker as the bracket arrangement is raised, a lower hole that limits the tilting movement of the rocker as the upright is raised and a central hole that corresponds to the neutral position of the rocker. In the centre of the groove in the inner disc there is a hole or recess that coincides in position with the central hole of the outer cover, wherein the spring positioner is inserted, preventing the rocker from moving in either direction and thus securing the neutral position thereof.

The rocker is thereby prevented from tilting excessively and accidentally passing from the position for raising the upright into the position for raising the bracket arrangement or vice versa.

The climbing system can be used not only to raise shuttering, but also for scaffolding or other structures and it can also serve to move beams, structures or different loads horizontally simply by being positioned horizontally and, specifically, to move formwork carriages for bridges, launching girders, bridge cranes, tunnel shuttering and, in general, any structure that involves a kinematic phase.

DESCRIPTION OF THE DRAWINGS

To complement this description and in order to aid a better understanding of the invention's characteristics, according to a preferred practical embodiment thereof, there is a set of illustrative and non-limiting drawings integral to said description, which are as follows.

PREFERRED EMBODIMENT OF THE INVENTION

Figure 1:
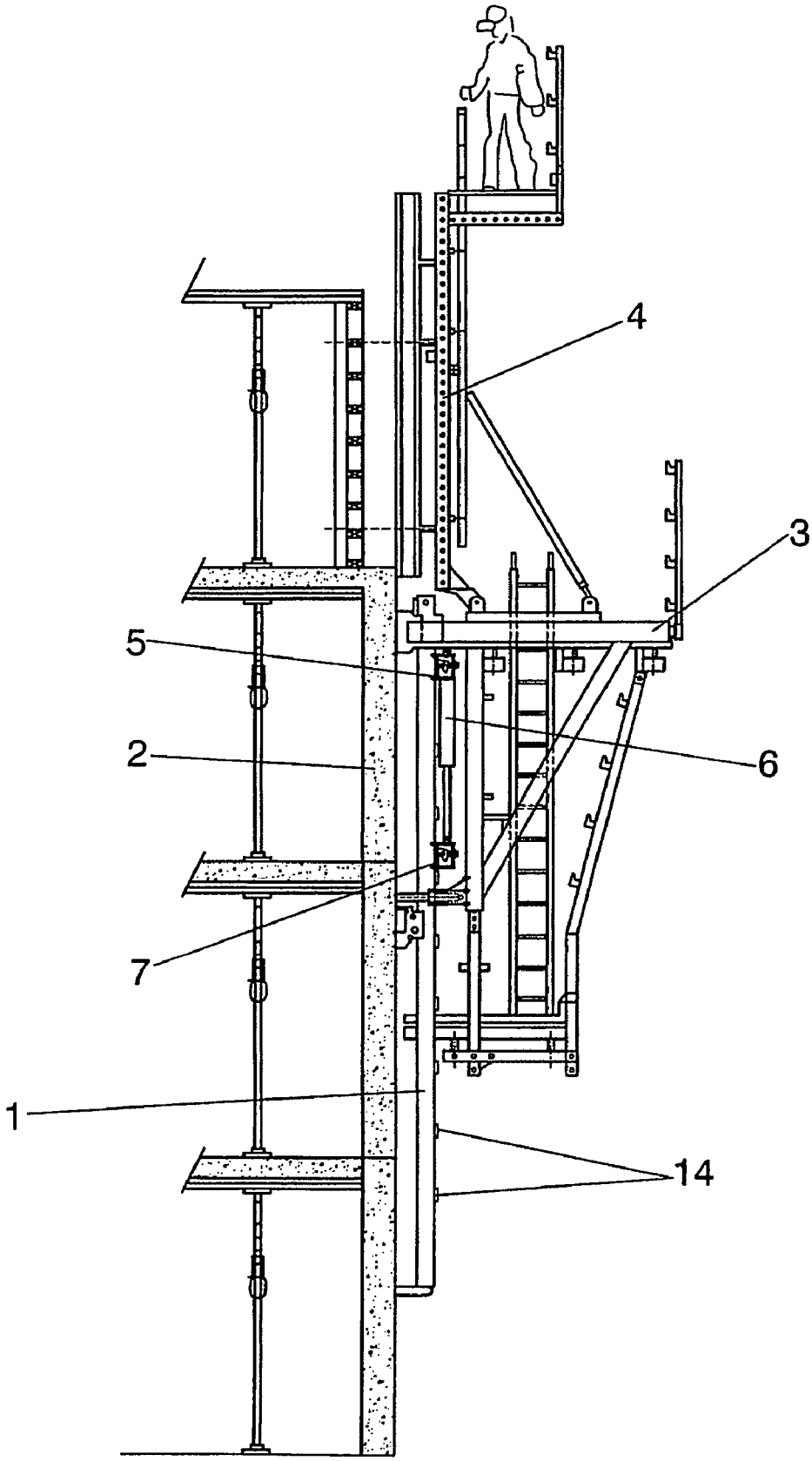
FIG. 1.—Is a side view showing the climbing system for shuttering attached to the wall with the shuttering disposed on an upper storey ready to cast the next section of the wall.
Figure 2:
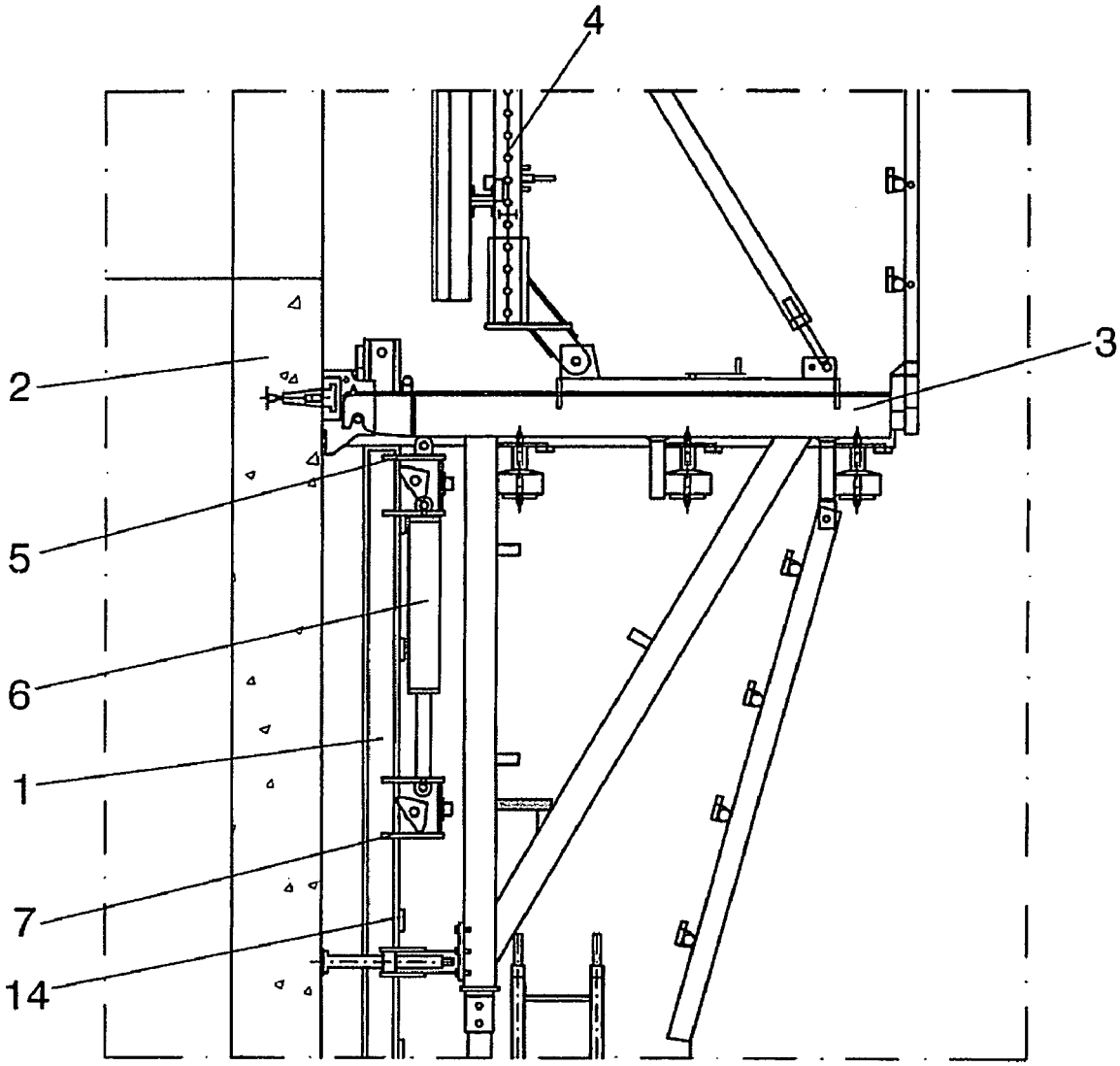
FIG. 2.—Is a detailed view of the previous figure showing the bracket arrangement, upper and lower heads, hydraulic cylinder and upright.
Figure 3:
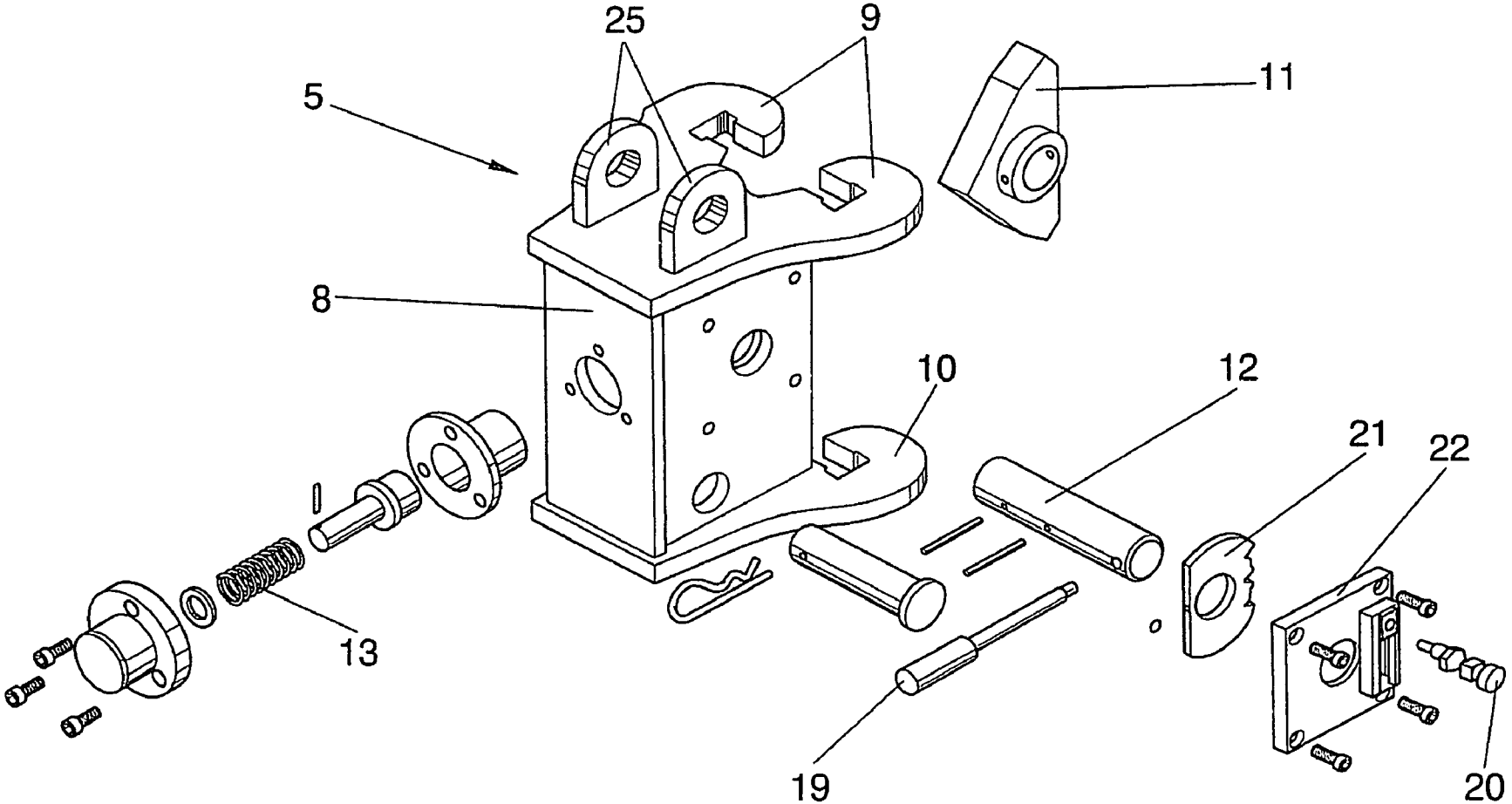
FIG. 3.—Is an exploded view of the upper head.

The climbing system for shuttering and suchlike basically comprises an upright (1), which can be fixed or can move vertically in relation to a wall (2), and a bracket arrangement (3), which can also be fixed or can move vertically in relation to the wall (2) with a movement relative to the upright (1), having mounted thereon a shuttering structure (4) for casting sections of the wall (2).

In addition to this basic configuration, the climbing system also incorporates an upper head (5) attached to the bracket arrangement (3) by means of lugs (25) and which is also solidly joined to the body of a hydraulic cylinder (6) the rod whereof is attached to a lower head (7), both heads (5) and (7) having a body (8) with upper (9) and lower (10) wings defining therebetween guides that encircle the upright (1), the body (8) comprising a rocker (11) mounted on a transversal axis (12) against the action of a spring (13) with which it is in permanent contact, the rocker (11) constituting a contact surface with prismatic flanges (14) defined on the upright (1) to raise or lower the bracket arrangement (3) or the upright (1) due to the displacement of the hydraulic cylinder (6).

The rocker (11) is practically triangular in form, with an inclined plane that, as it makes contact with the flanges (14) on the upright (1) in its upward or downward movement, tilts against the action of the spring (13) and presses it so that, once the flange (14) has been passed, it subsequently resumes its position, this inclined plane ending in a bevelled upper vertex with an upper face (15), and a bevelled lower vertex with a lower face (17).

Figure 4:
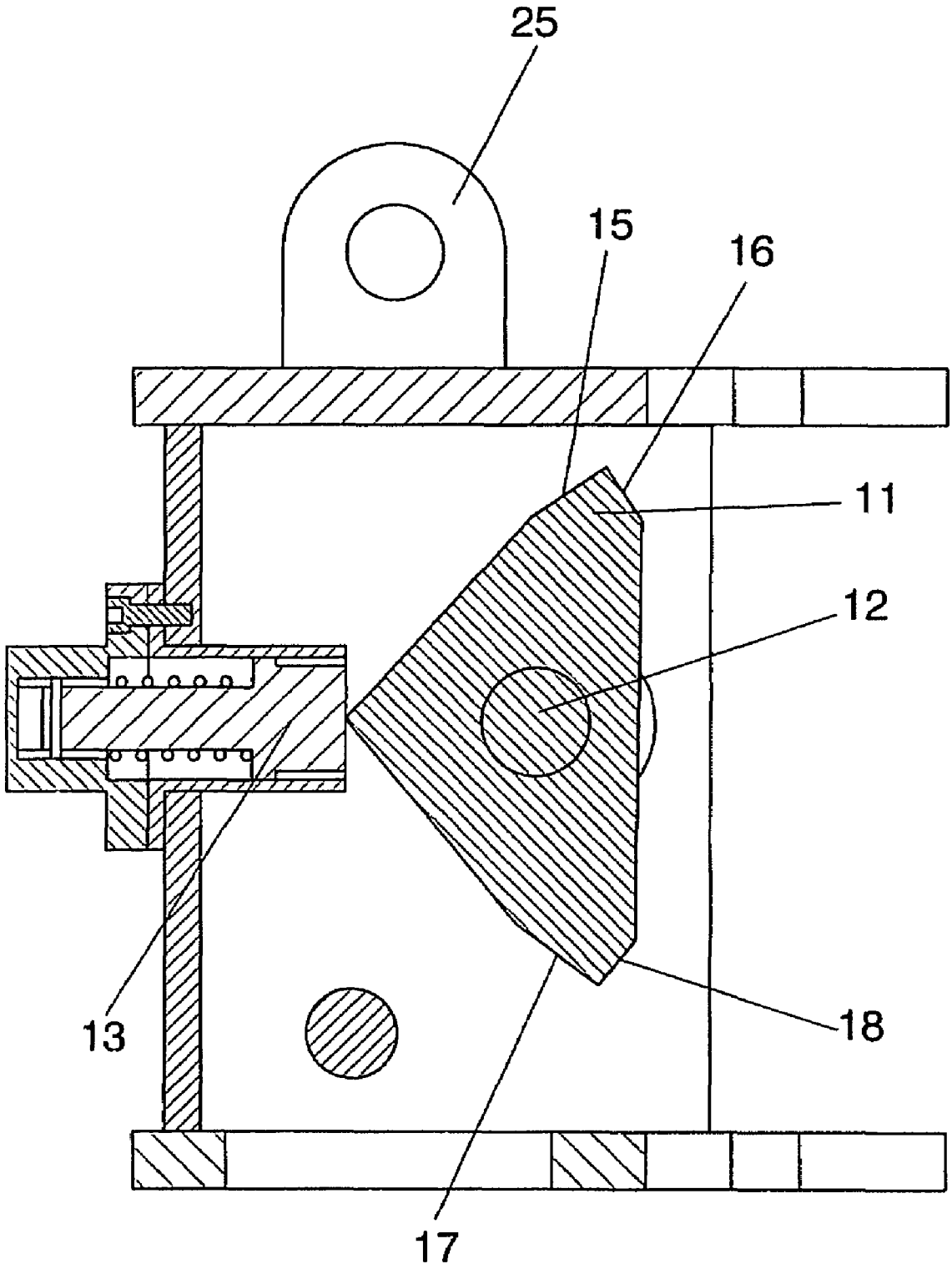
FIG. 4.—Is a cross-section view of the upper head with the rocker situated in the neutral position.
Figure 5:
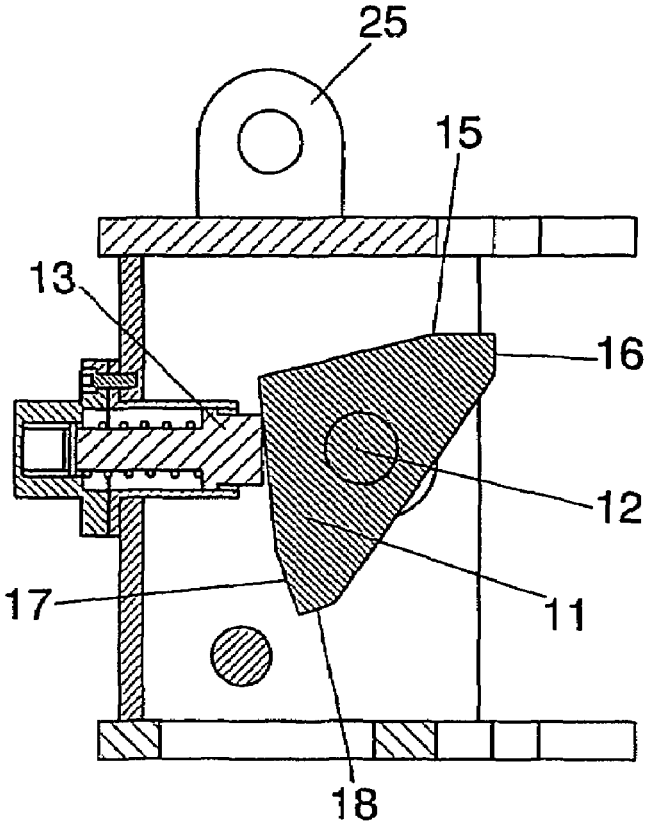
FIG. 5.—Is a cross-section view of the upper head with the rocker situated in the position for raising the upright.
Figure 6:
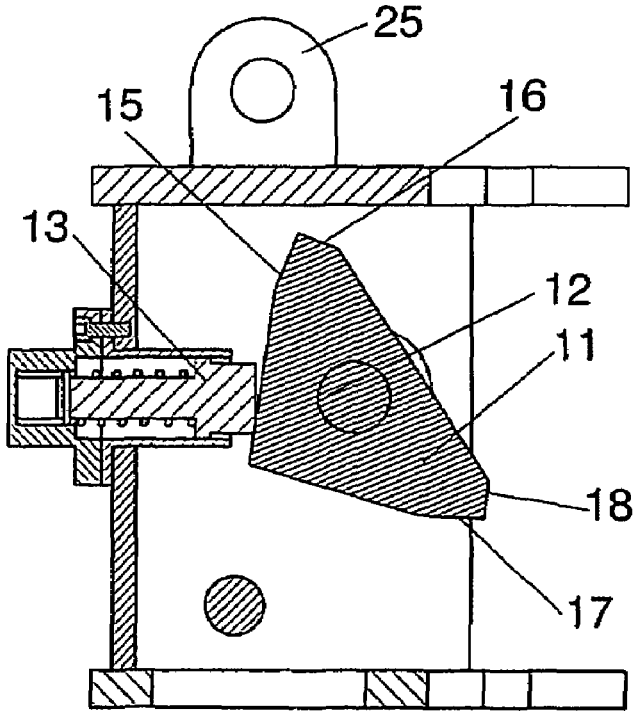
FIG. 6.—Is a cross-section view of the upper head with the rocker situated in the position for raising the bracket arrangement.
Figure 7:
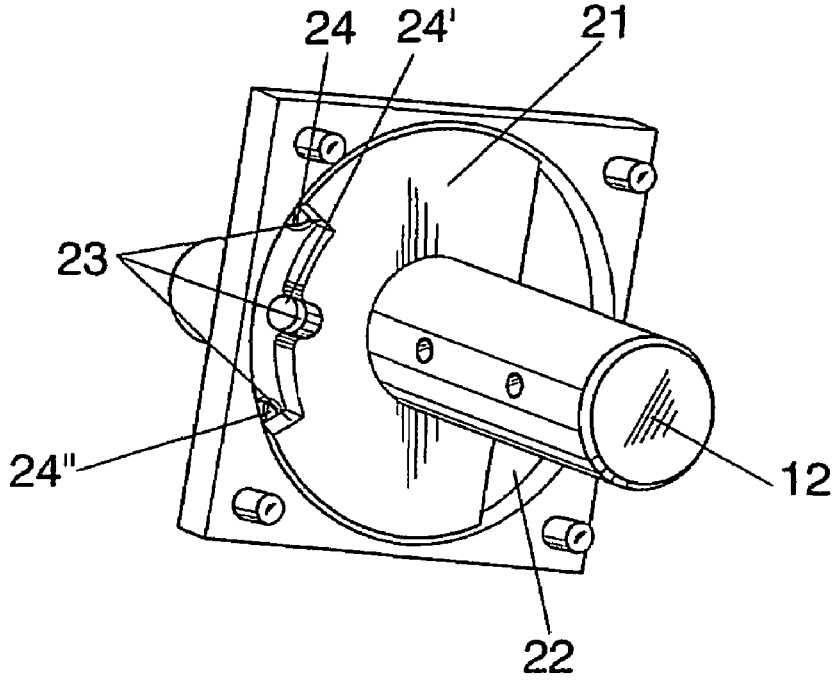
FIG. 7.—Is a perspective view of the safety device showing the outer cover with the holes that define the limit of the tilting movement of the rocker for its different positions, and the inner disc that moves with the movement of the rocker.
Figure 8:
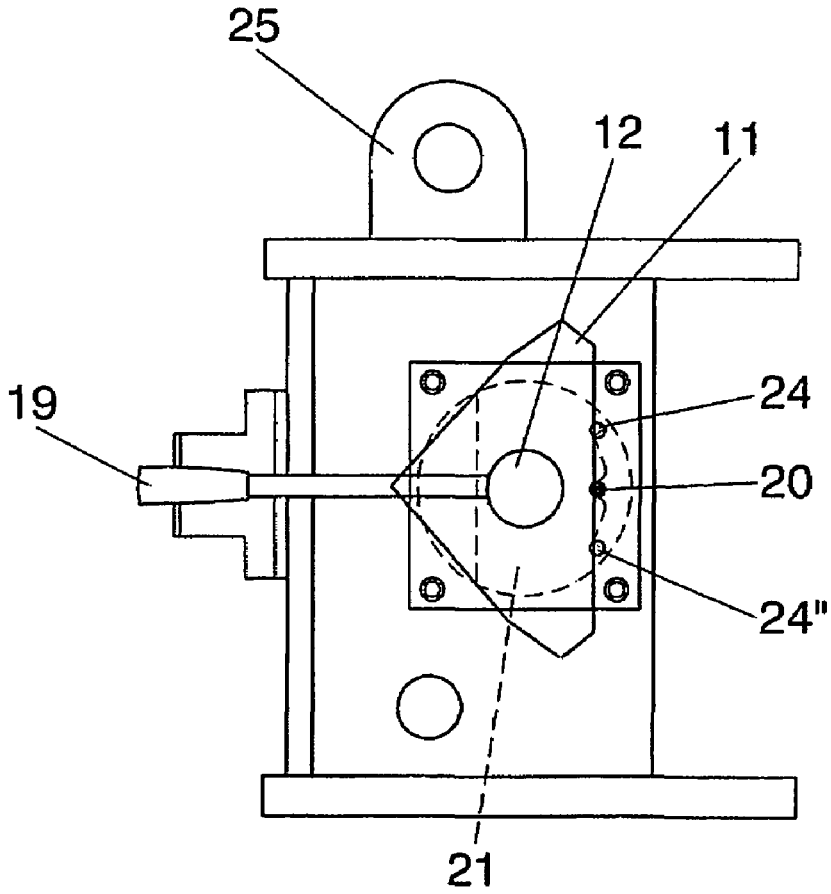
FIG. 8.—Is a side view of the upper head showing the neutral position of the rocker with the inner disc abutting against the spring positioner inserted in the central hole of the outer cover.
Figure 9A:
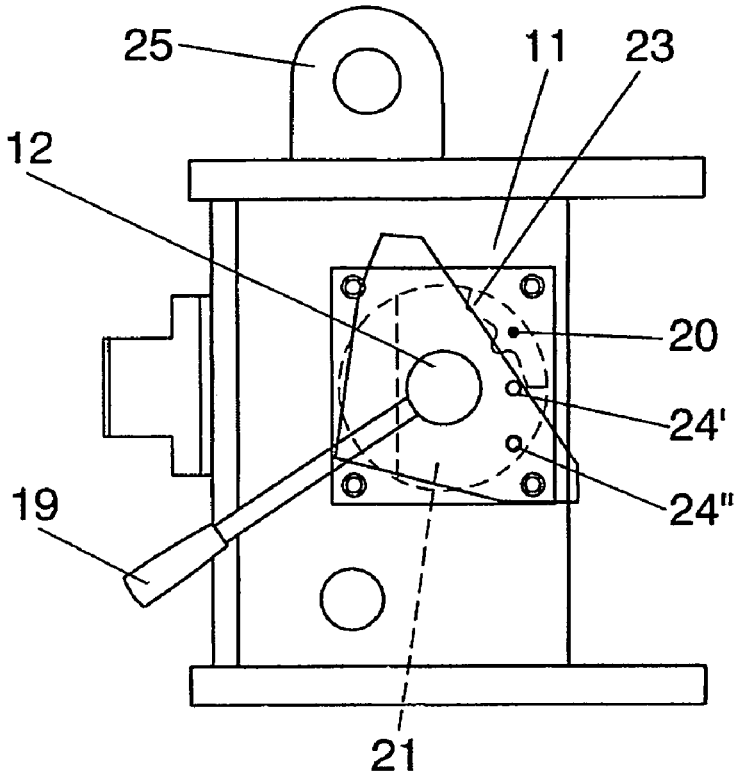
FIGS. 9A and 9B.—Are side views of the upper head showing the position of the rocker for raising the bracket arrangement, with the inner disc in the situation immediately prior to abutting against the spring positioner inserted into the upper hole (FIG. 9A) and in the situation immediately subsequent to abutting against said positioner (FIG. 9B).
Figure 9B:
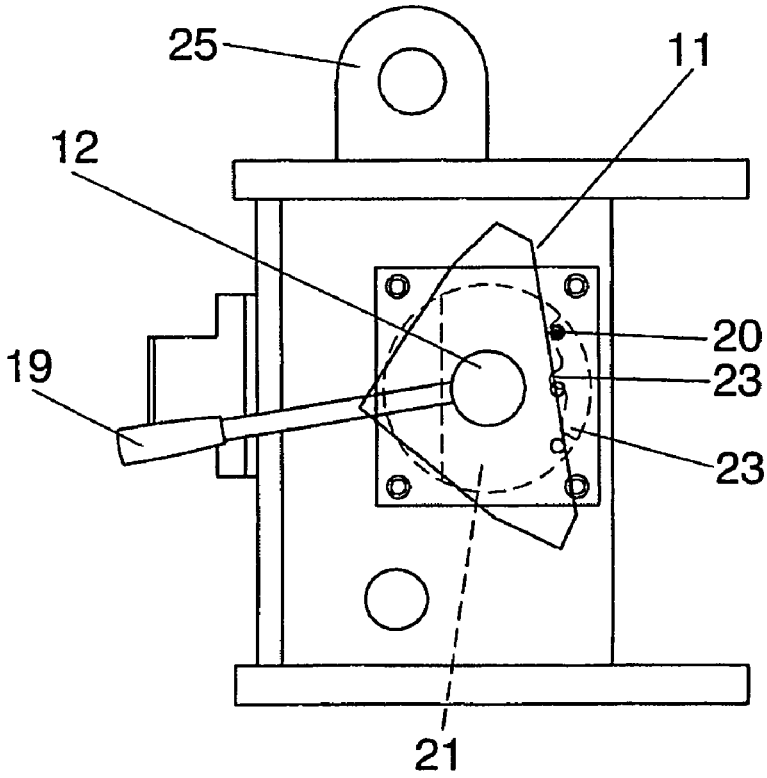
Figure 10A:
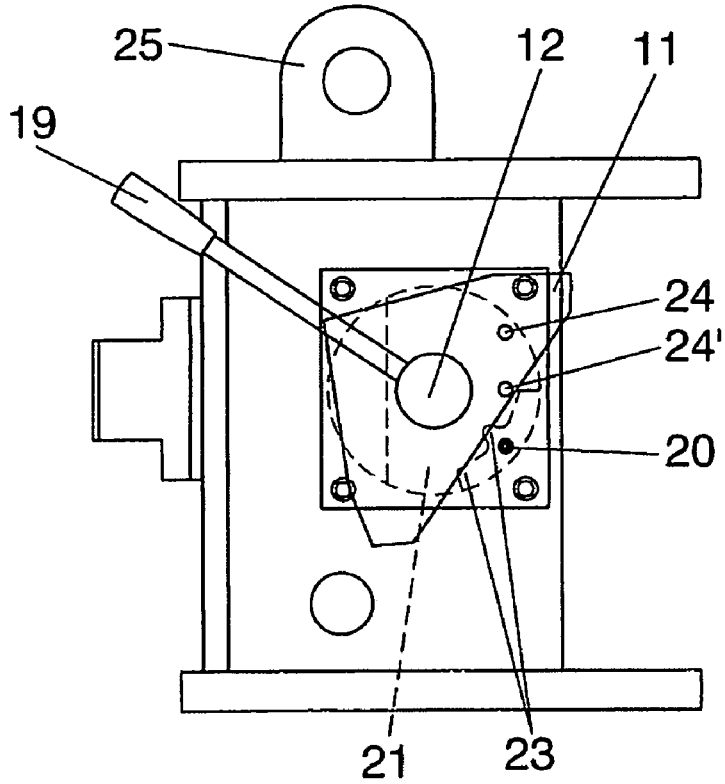
FIGS. 10A and 10B.—Are side views of the upper head showing the position of the rocker for raising the upright with the inner disc in the situation immediately prior to abutting against the spring positioner inserted into the lower hole (FIG. 10A) and in the situation immediately subsequent to abutting against said positioner (FIG. 10B).
Figure 10B:
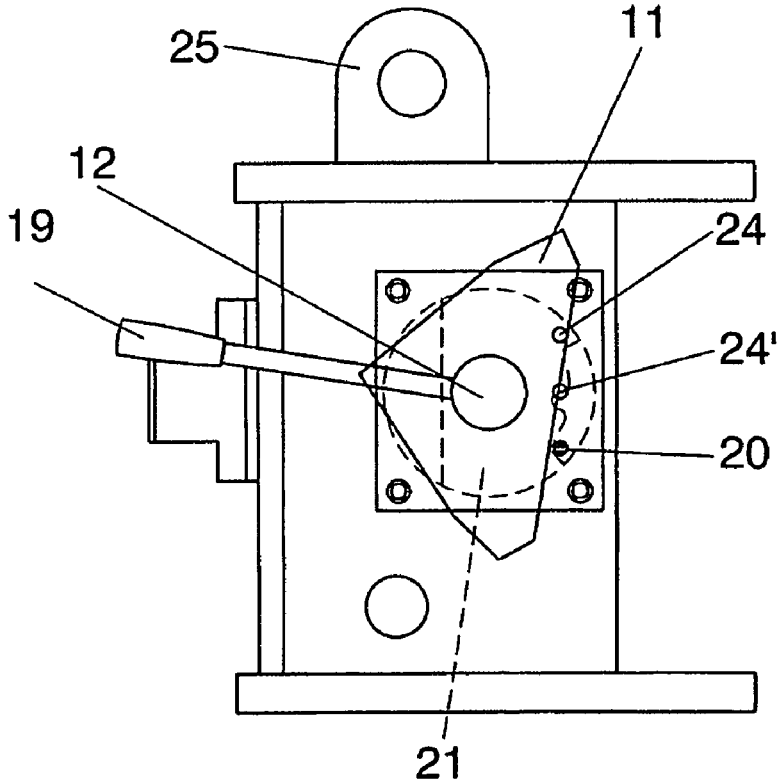

The rocker (11) can be tilted by means of an outer handle (19) attached to the transversal axis (12), which defines the different operating positions of the head and, specifically, a position for raising the upright wherein the upper face (15) of the rocker (11) is in a horizontal position, as can be observed in FIG. 5, and pushes upwards on a flange (14) on the upright (1) to raise it, a neutral position, as shown in FIG. 4, wherein the inclined plane is parallel to the upright (1) corresponding to the concreting situation, and a position for raising the bracket arrangement wherein the lower face (17) of the rocker (11) is in a horizontal position, as can be observed in FIG. 6, resting on a flange (14) on the upright (1) to help raise the bracket arrangement (3).

On the upper vertex of the rocker (11), perpendicular to the upper face (15), there is an upper front face (16) that is in contact with the surface of the upright (1), preventing its rotation in the position for raising the upright as it pushes on the flange (14), whilst on the lower vertex of the rocker, perpendicular to the lower face (17), there is a lower front face (18) that is in contact with the surface of the upright, preventing its rotation in the position for raising the bracket arrangement as it rests on the flange (14).

However, in the other direction of movement the rocker (11) is in contact by its inclined plane with one of the flanges (14) on the upright as it moves, being able to tilt slightly, compressing the spring (13), in such a way that, once the position of the flange (14) has been passed, the spring (13), which is loaded, pushes and returns the rocker to its position.

The system also incorporates a safety device that comprises an inner disc (21) that moves with the tilting movement of the rocker (11) and which has a peripheral notch that defines a groove (23), which works with a spring positioner (20) that is housed, depending on the operating position of the rocker, in one of the three (24), (24'), (24") holes provided in the outer cover (22) of the head, in such a way that the tilting movement of the rocker is limited when the spring positioner (20) comes into contact with the edges of the groove (23) in the inner disc (21).

Specifically, there is an upper hole (24) wherein the spring positioner (20) is inserted to define the position that limits the tilting movement of the rocker (11) as the bracket arrangement (3) is raised, a central hole (24') that defines the neutral position of the rocker (11), and a lower hole (24") wherein the spring positioner (20) is inserted, which defines the position that limits the tilting movement of the rocker (11) as the upright is raised (1), there being in the central area of the groove (23) a hole or recess that coincides in position with the central hole (24') of the outer cover, wherein the spring positioner (20) is inserted, preventing the rocker from moving in either direction and thus securing the neutral position of the rocker.

Figure 11A:
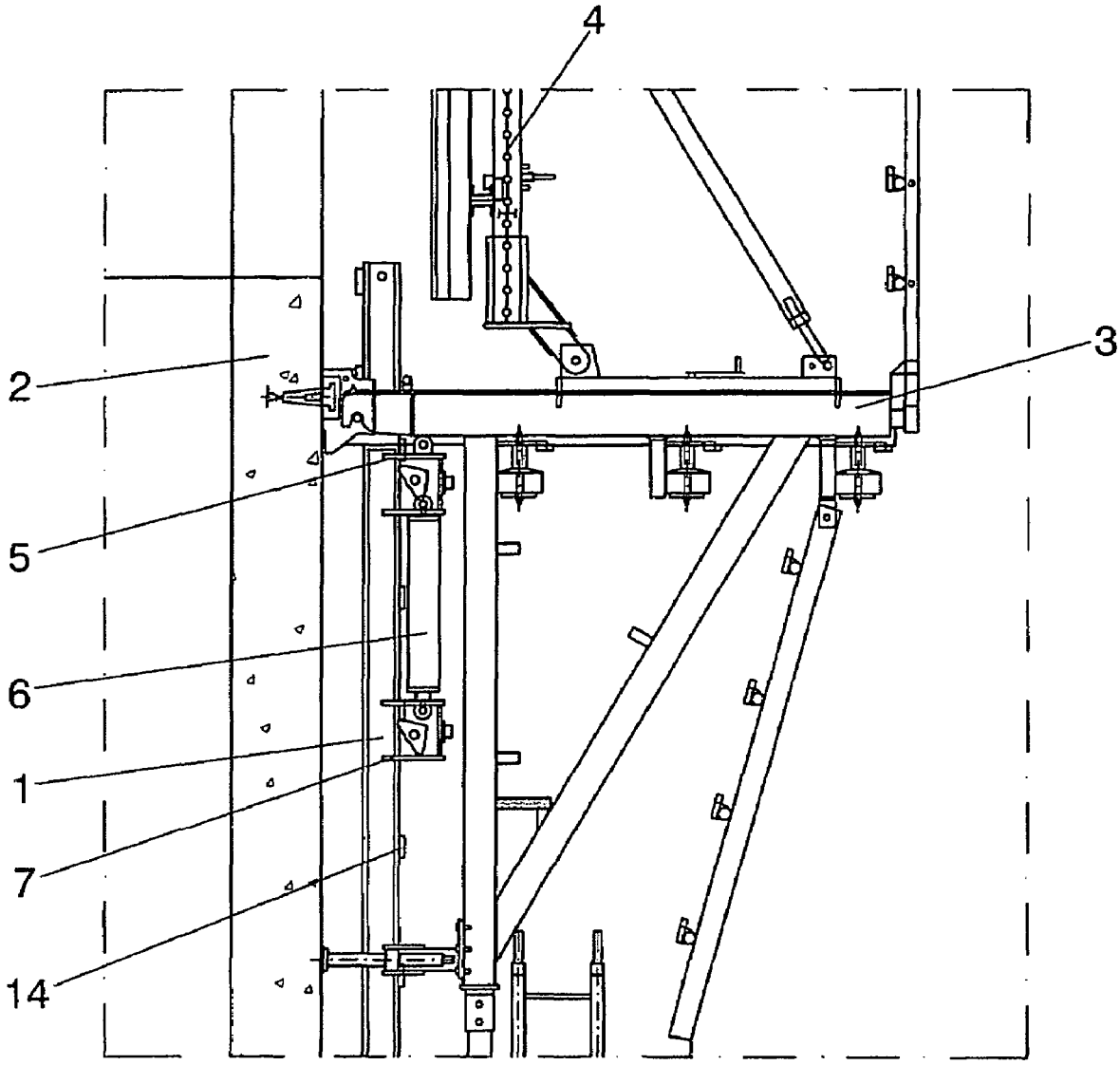
FIGS. 11A to 11D.—Are side views corresponding to the principal phases involved in raising the upright showing the movement of the upright and the cylinder.
Figure 11B:
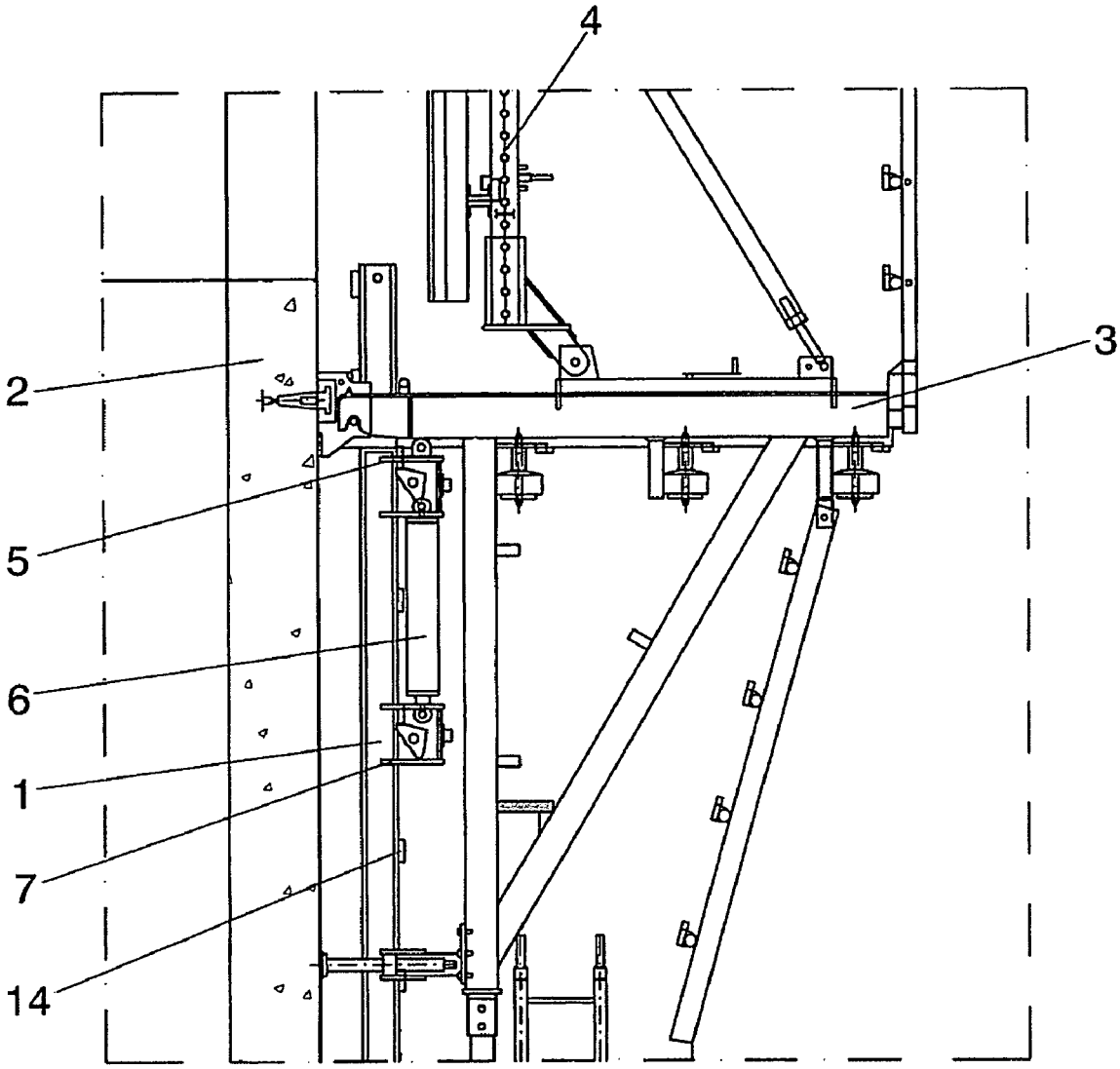
Figures 12A, 12B, 12C, 12D, 12E:
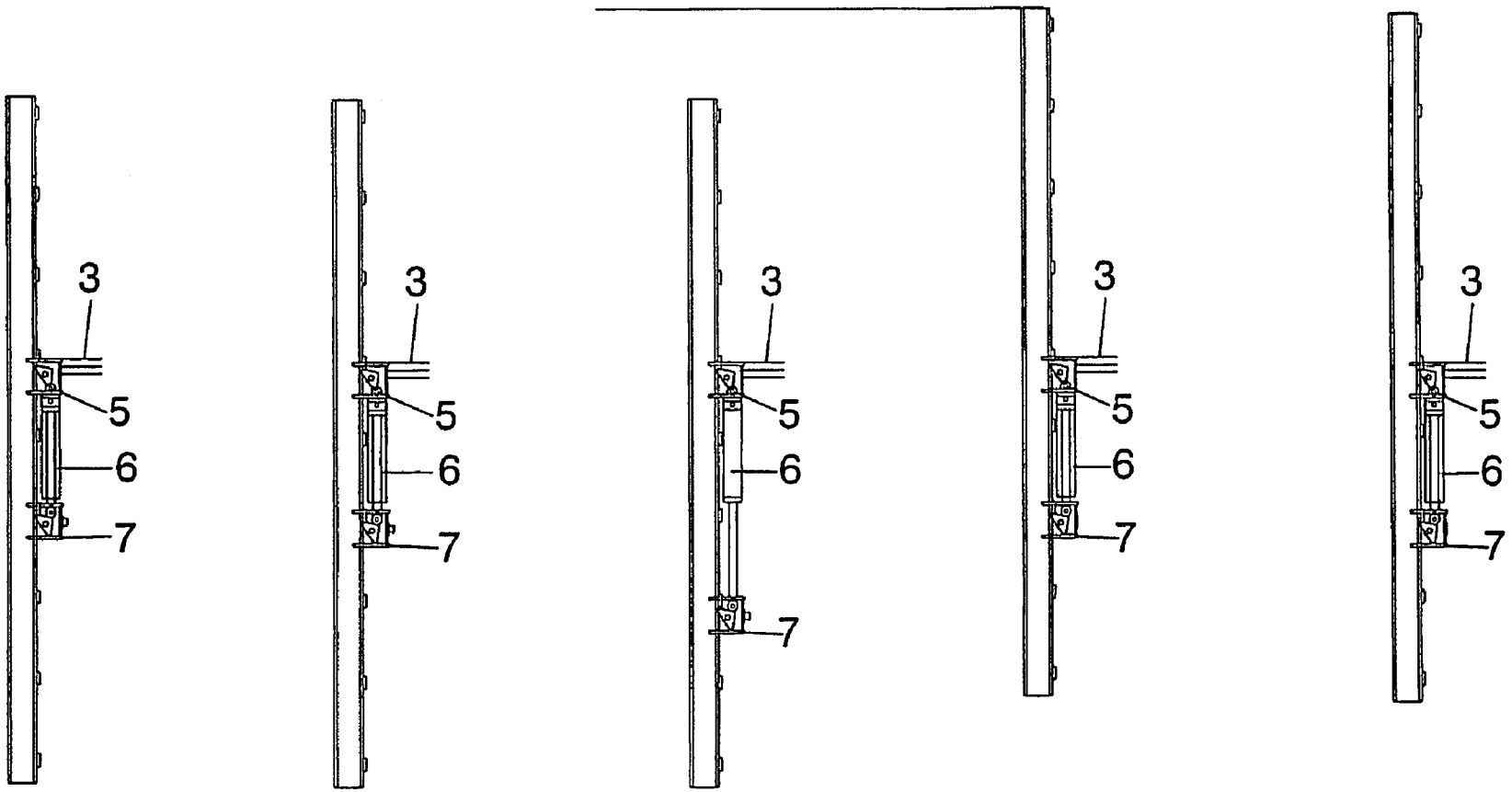
FIGS. 12A to 12I.—Are side views showing all the phases involved in raising the upright.

The climbing system works according to the phases described below:

- FIGS. 11A and 12A describe the position wherein the bracket arrangement (3) is fixed to the wall (2), with the hydraulic cylinder (6) retracted and the upright (1) supported by the rocker (11) of the lower head (7). The rockers (11) of the upper head (5) and the lower head (7) have their upper face (15) in a horizontal position corresponding to the position for raising the upright (1).
- Then in FIGS. 11B and 12B, the upright (1) is separated from the wall (2), the hydraulic cylinder (6) begins to extend, causing the upright (1) to descend until one of its flanges (14) rests on the upper face (15) of the rocker (11) of the upper head (5), the upright (1) being supported from then on by the upper head (5). The upright (1) has descended a short distance that will be compensated for as it is raised.

Figure 11C:
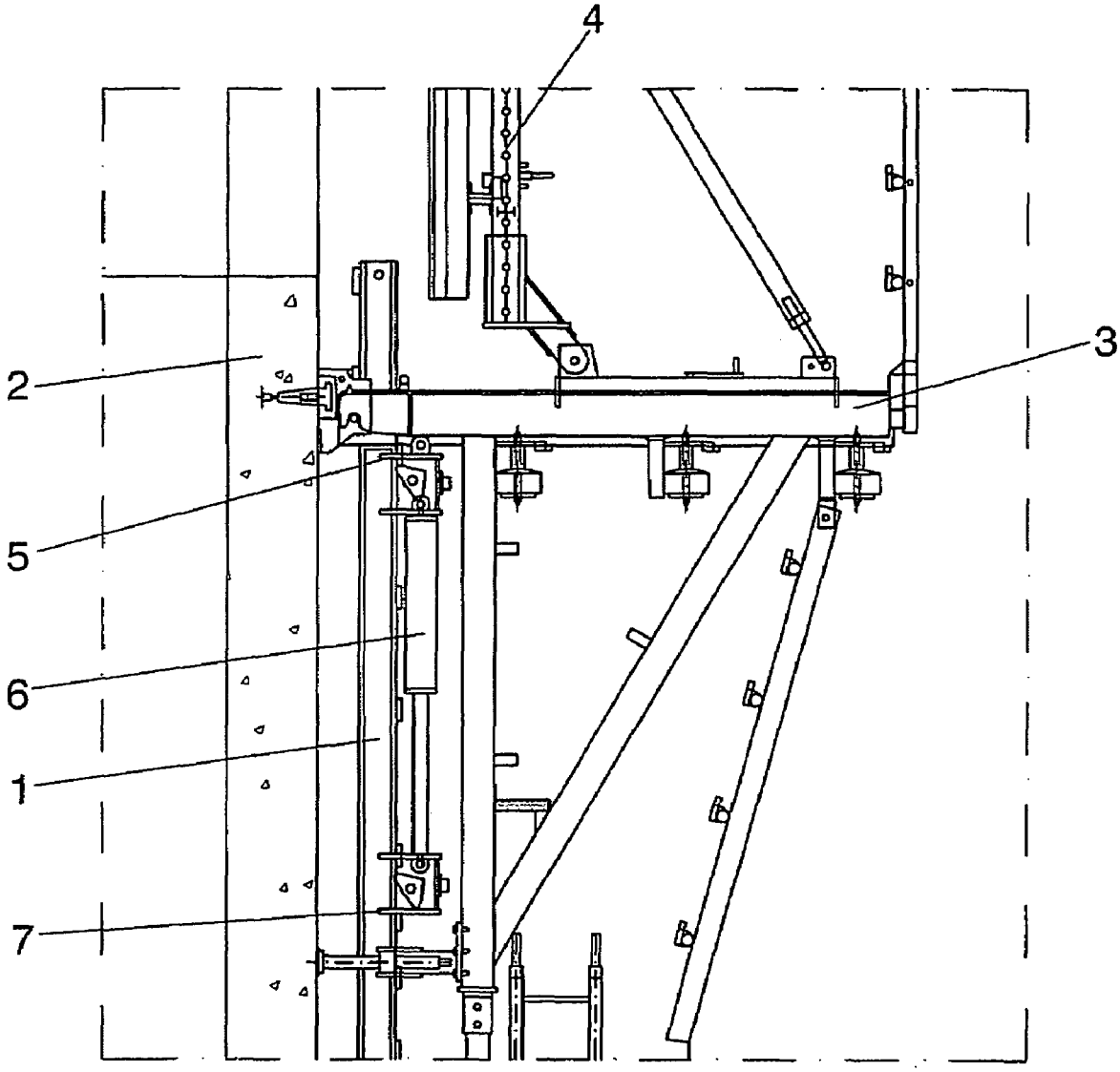

It can then be seen in FIGS. 11C and 12C that from the situation wherein the upright (1) rests on the upper head (5), the cylinder (6) continues to extend until it finishes its complete stroke, the lower head (7) passing over the following flange (14). The rocker (11) of the lower head (7) makes contact with the flange (14) by its inclined plane, rotating clockwise and loading the spring (13) until, once the flange (14) has been passed, the spring (13) returns the rocker (11) to its working position. The stroke of the cylinder (6) corresponds to the separation between two flanges (14) on the upright (1) to which a compensation distance must be added, which corresponds with the length that the upright (1) has descended in the previous phase and an additional complementary distance that allows the rocker (11) to pass the flange (14) and remain slightly below this.

Figure 11D:
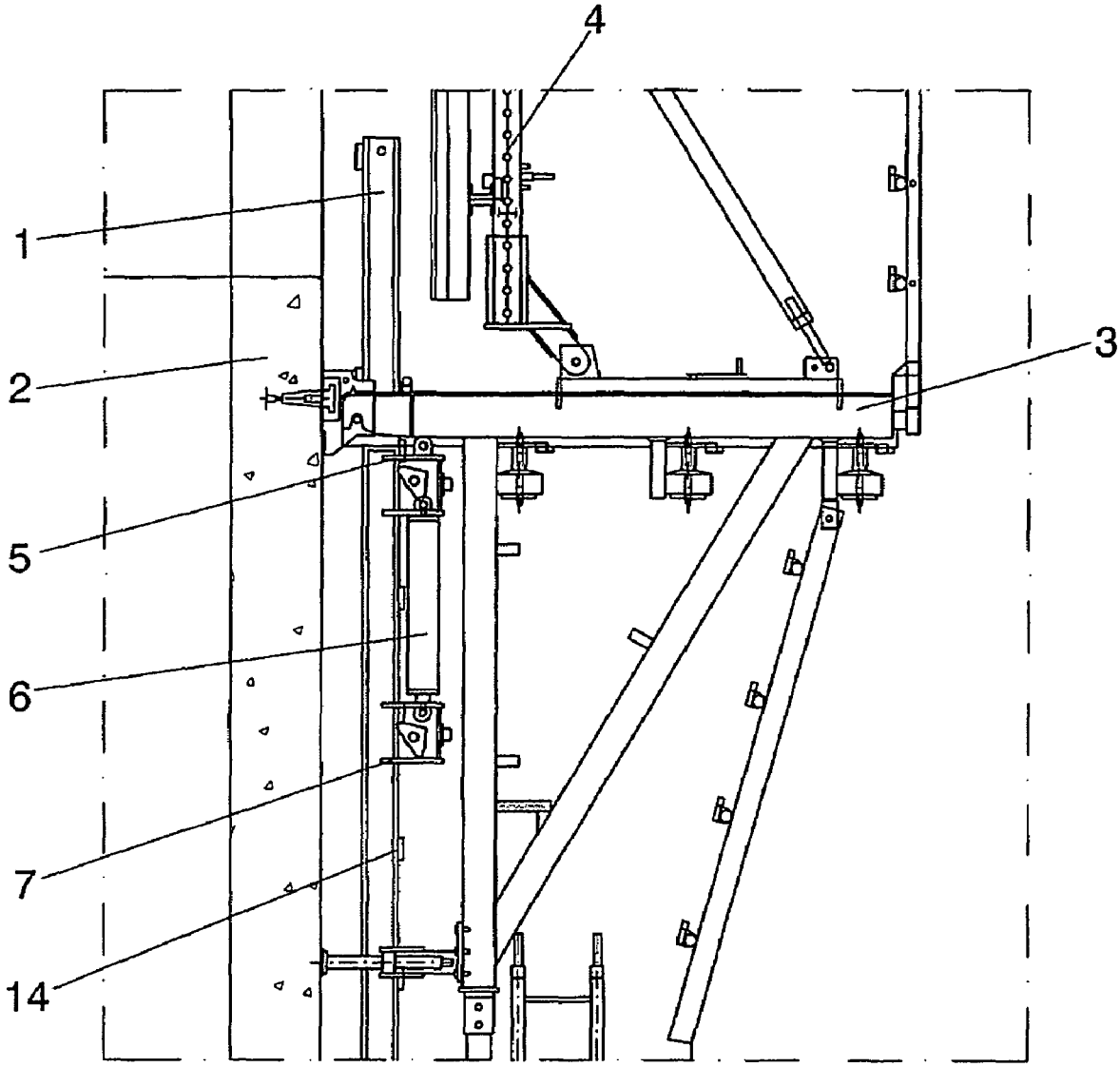

FIGS. 11D and 12D show the retraction of the cylinder (6), which raises the lower head (7). As the lower head (7) ascends, its rocker makes contact with a flange (14) and pushes it upwards, forcing the upright (1) to ascend. The hydraulic cylinder (6) finishes its complete retracting stroke, so that the upper flange (14) of the upright (1) passes the rocker (11) of the upper head (5), being in a similar position to those described in FIGS. 11B and 12B. The spring (14) passes the rocker (11) of the upper head (5), making it rotate and loading the compression spring (13) until, once the rocker (11) has passed, the spring returns it to its working position.

These operations are repeated as many times as necessary until the desired higher level for anchorage on the wall (2) is achieved. This can be observed in FIGS. 12E, 12F and 12G.

The upright (1) is anchored to the anchoring point provided in the wall (2). During these phases, the bracket arrangement (3) has remained fixed to the wall and, consequently, the upper head (5) has not moved during any of the previous phases. The position of the rocker is then changed using the handle, situating it in the position for raising the bracket arrangement, i.e. with its lower face in a horizontal position, as can be observed in FIG. 12H.

Figure 12I:
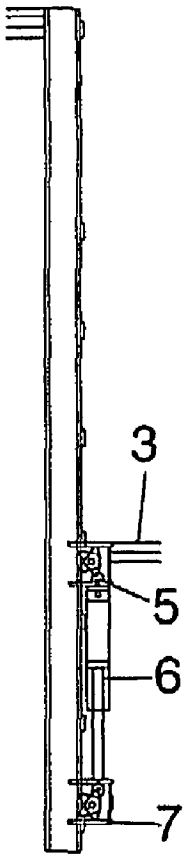
Figure 12H:
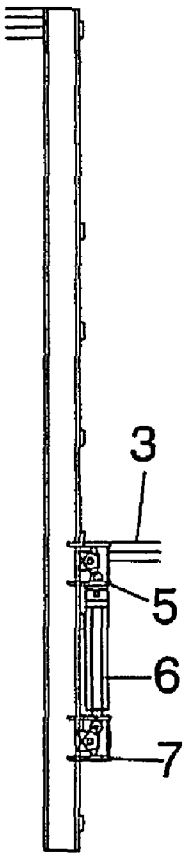
Figure 12G:
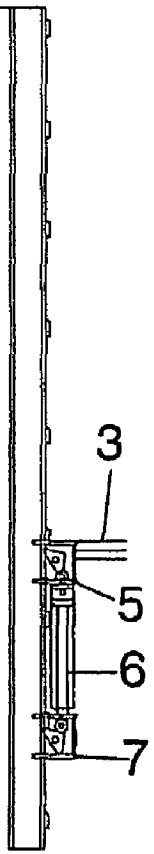
Figure 12F:
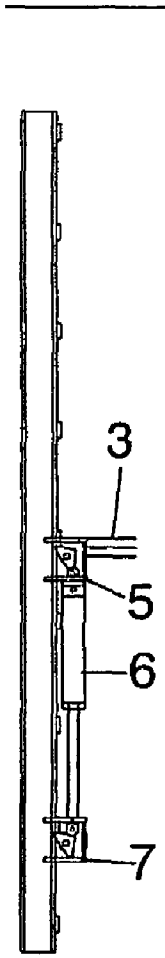
Figure 13A:
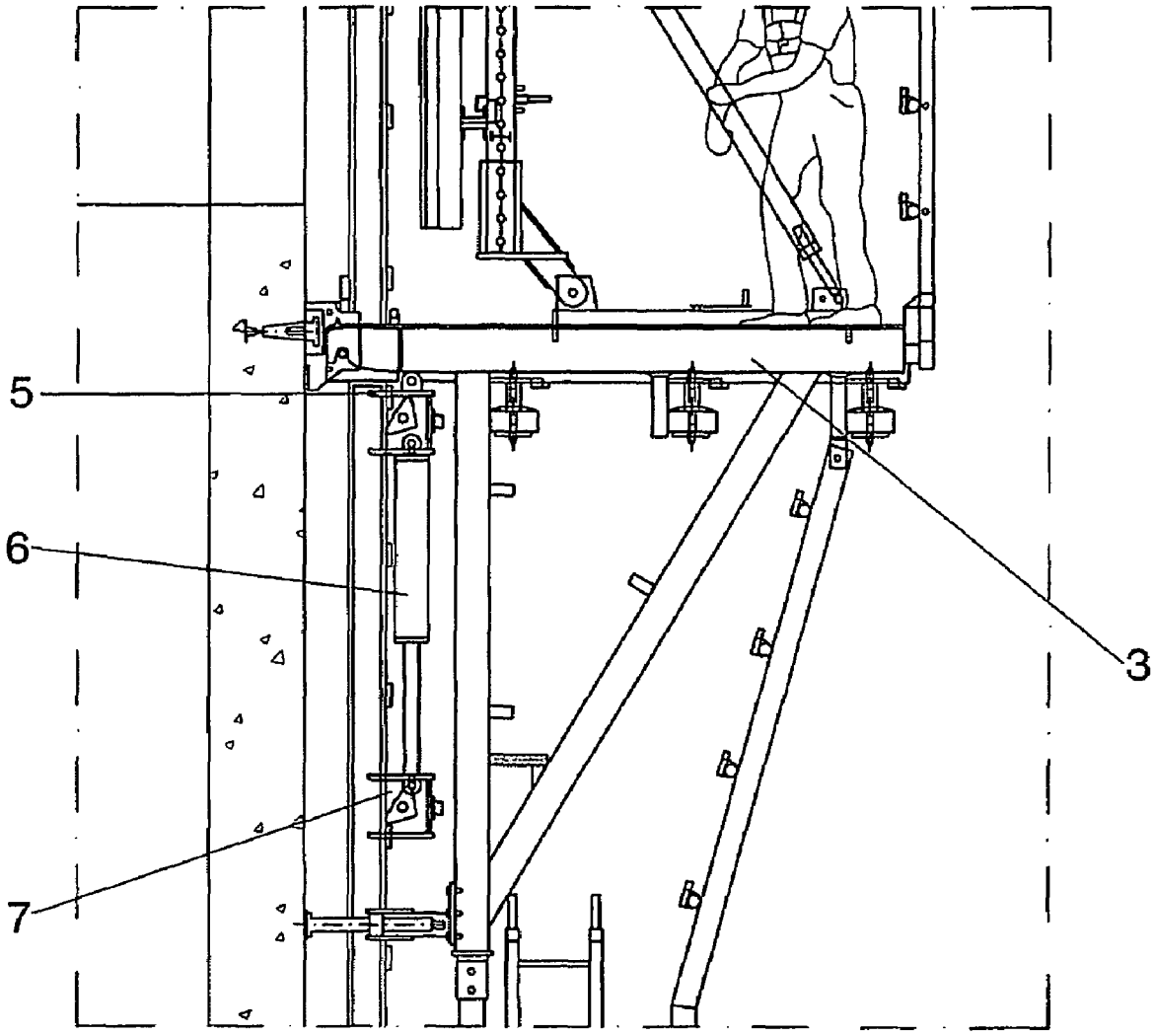
FIGS. 13A to 13D.—Are side views corresponding to the principal phases involved in raising the bracket arrangement showing the movement of the upright and the cylinder.
Figure 14E:
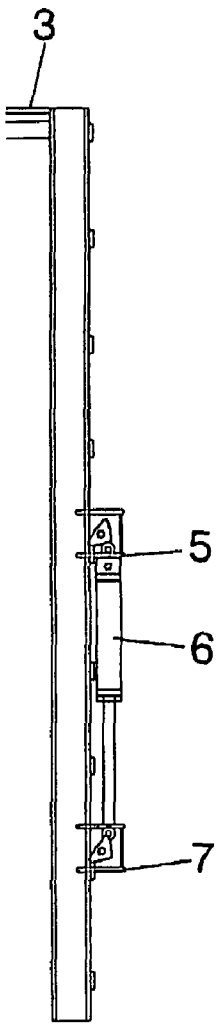
FIGS. 14A to 14I.—Are side views showing all the phases needed to raise the bracket arrangement.
Figure 14D:
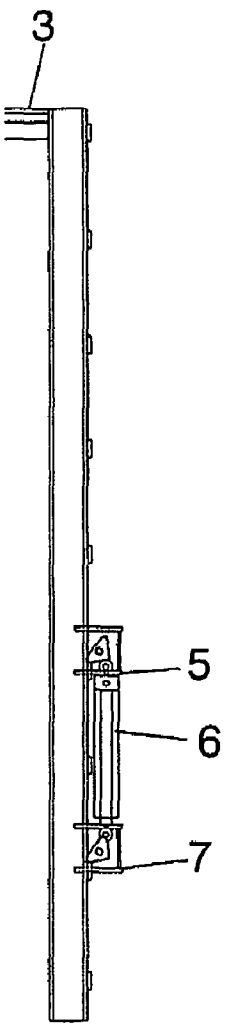
Figure 14C:
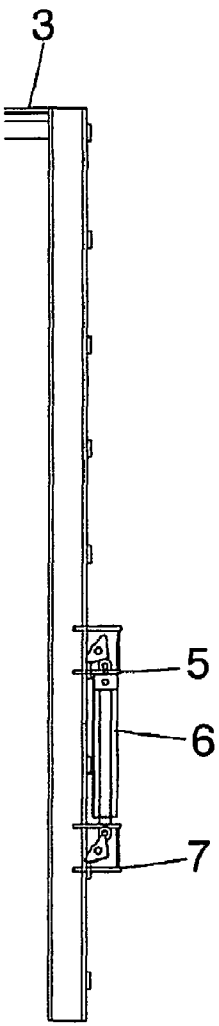
Figure 14B:
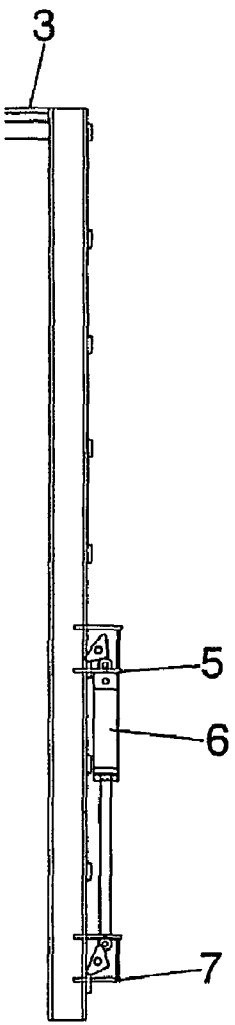
Figure 14A:
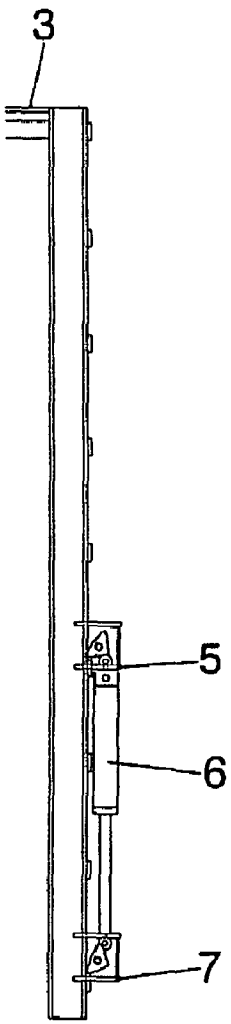

The cylinder then extends until the rocker of the lower head (7) rests on the lower flange of the upright (1), as can be observed in FIG. 12I. The bracket arrangement is then unfastened from the wall and the process of raising it begins according to the following operations:

FIGS. 13A and 14A show how the extension of the cylinder continues so that, resting against the lower flange, it pushes the bracket arrangement upwards causing the rocker of the upper head (5) to pass the flange (14) on the upright (1). To do this, the rocker (11) rotates as it makes contact with the flange (14), loading the compression spring (13). When the flange has been passed with a certain clearance, the spring (13) returns the rocker (11) to its working position.

Figure 13B:
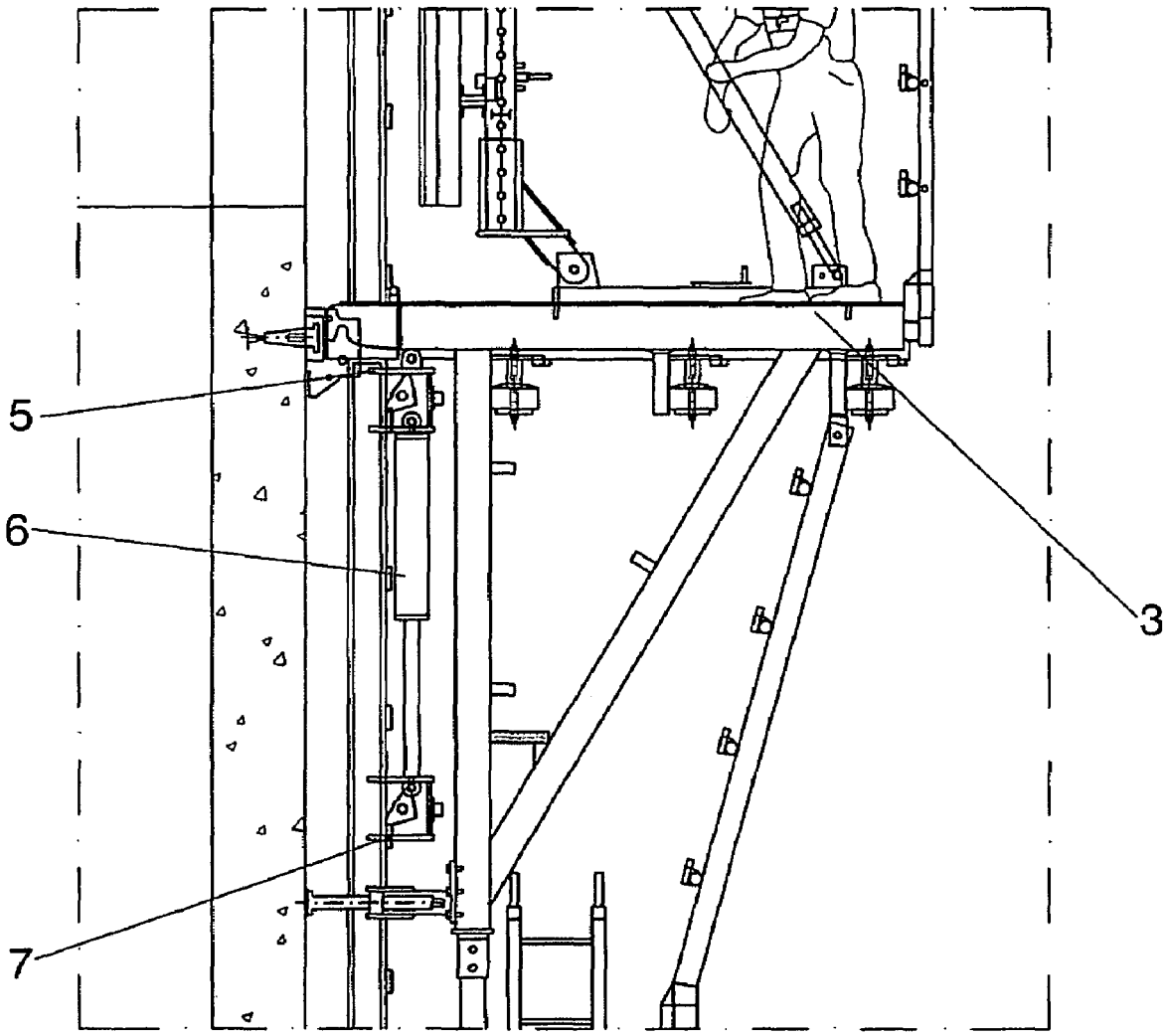

In FIGS. 13B and 14B the cylinder begins to retract, lowering the bracket arrangement (3) until the rocker of the upper head (5) rests on the upper flange.

Figure 13C:
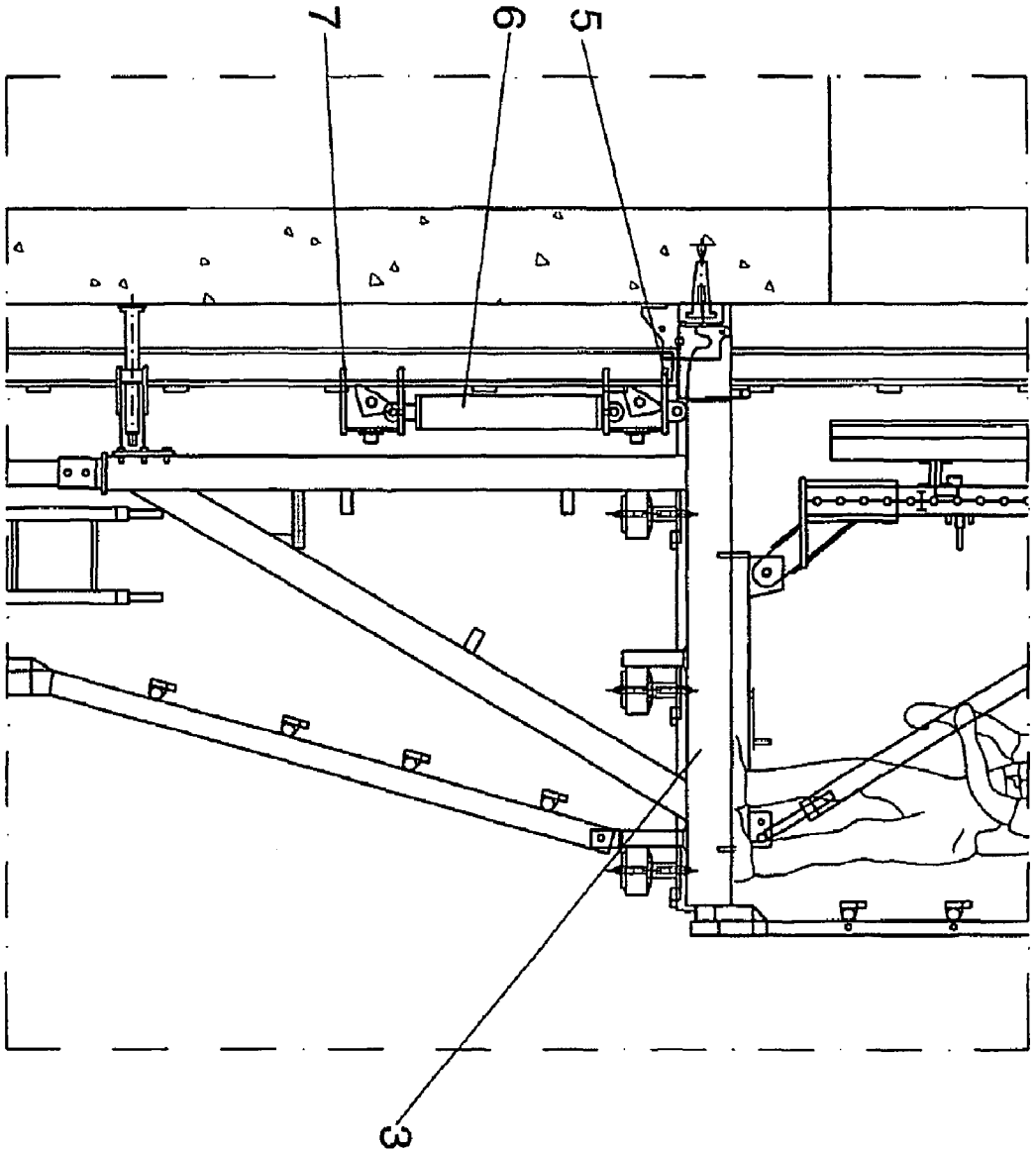

FIGS. 13C and 14C show the cylinder (6) totally retracted, the rocker of the lower head (7) having passed one of the flanges (14) on the upright (1), returning to its working position due to the loading and unloading of the spring (14).

Figure 13D:
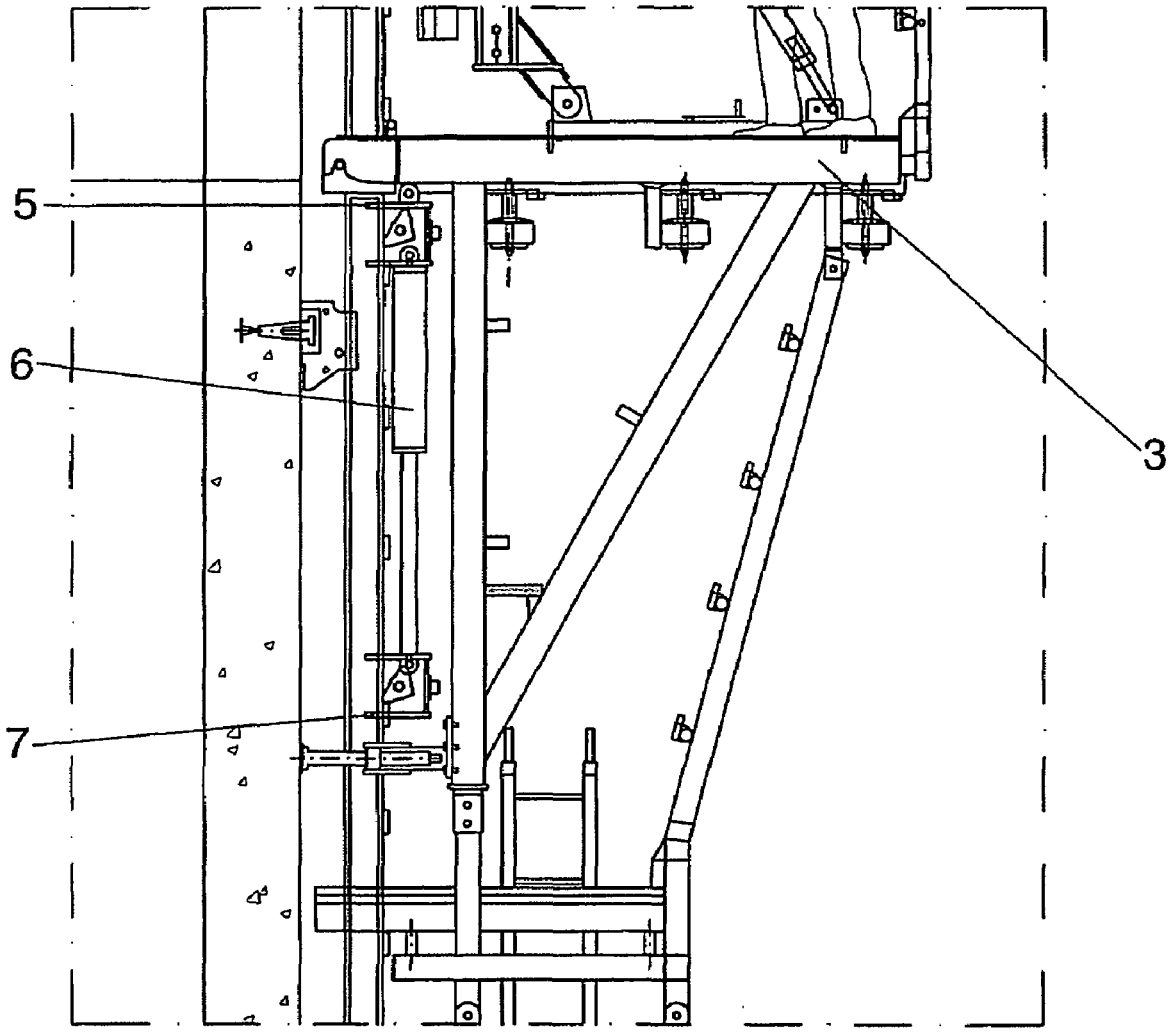

FIGS. 13D and 14D show how the cylinder begins to extend so that the rocker of the lower head (7), resting against the flange (14) on the upright (1), starts to raise the bracket arrangement (3).

The four last phases or operations described above are then repeated, as shown in FIGS. 14E, 14F, 14G and 14H, until the bracket arrangement (3) reaches the desired position wherein to anchor it to the wall.

Figure 14I:
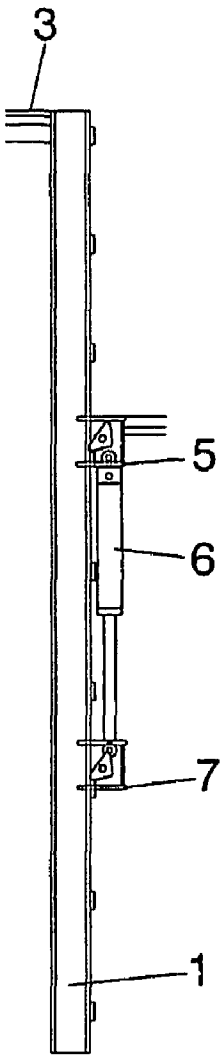
Figure 14H:
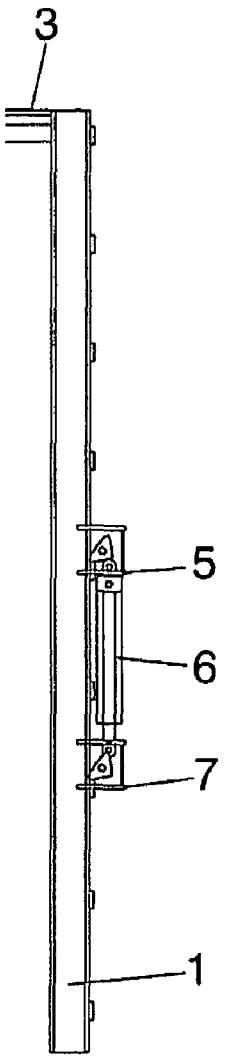
Figure 14G:
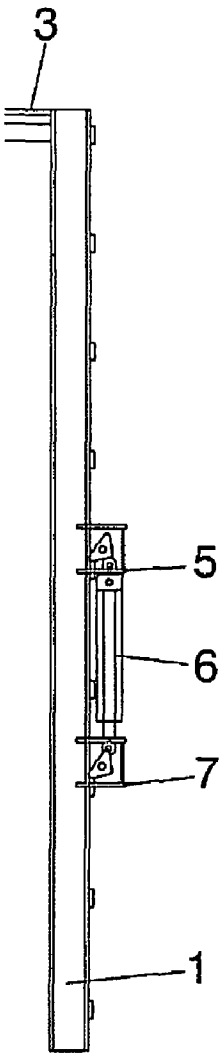
Figure 14F:
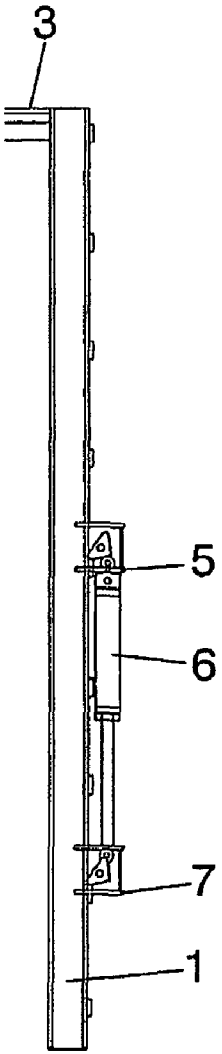

The bracket arrangement (3) is anchored to the wall (2), as can be observed in FIG. 14I, so that the concreting work can be performed, with the upright (1) also anchored to the wall (2), the rockers (11) being positioned in the neutral position so that the system of the loads that it supports can be unloaded. Furthermore, in this position it is possible to prevent the upright or the bracket arrangement from accidentally moving if someone acts on the raising mechanisms.

From this position, to begin another phase of raising the upright (1), the position of the rockers (11) must be changed by actuating the handle (19) and the aforedescribed process is repeated.

As aforesaid, the operations involved in raising the upright (1) and the bracket arrangement (3) are automatic, i.e. once the heads have been positioned in the corresponding function using the handle, it is not necessary to touch them until all the corresponding working phases have finished.

The lowering operation is less usual and somewhat more complex as it is necessary to change the position of the heads, actuating the handle on each stroke, both to lower the upright (1) and to lower the bracket arrangement (3).

Basically, to lower the upright (1) it is necessary to make it rest on the rocker of the lower head (7) and lower it by resting it on the hydraulic cylinder (6). The upright (1) has to fall due to its weight, which means that on the descent thereof it must be ensured that the upper head (5) is in the position for raising the bracket arrangement, so that the flanges (14) on the upright (1) can pass to the rocker (11) of the upper head (5). When the lower head (7) is moved, it must be the upper head (5) that supports the upright (1), making it necessary to change the operating position of the rocker (11) using the handle (19).

To lower the bracket arrangement (3) it is necessary to rest it on the lower head (7) and lower the upper head (5) that is solidly joined to the bracket arrangement (3). It must be ensured that, when the bracket arrangement is descending, the upper head (5) can pass the flanges (14) on the upright (1), which means that the rocker (11) must be in the position for raising the upright. When the lower head (7) must move and pass over a flange (14) to seek another point on which to rest, the rocker (11) of the lower head (7) must be positioned in the position for raising the upright in order to pass the flange (14) and must then resume the position for raising the bracket arrangement to rest on the flange (14) again.

Figure 15:
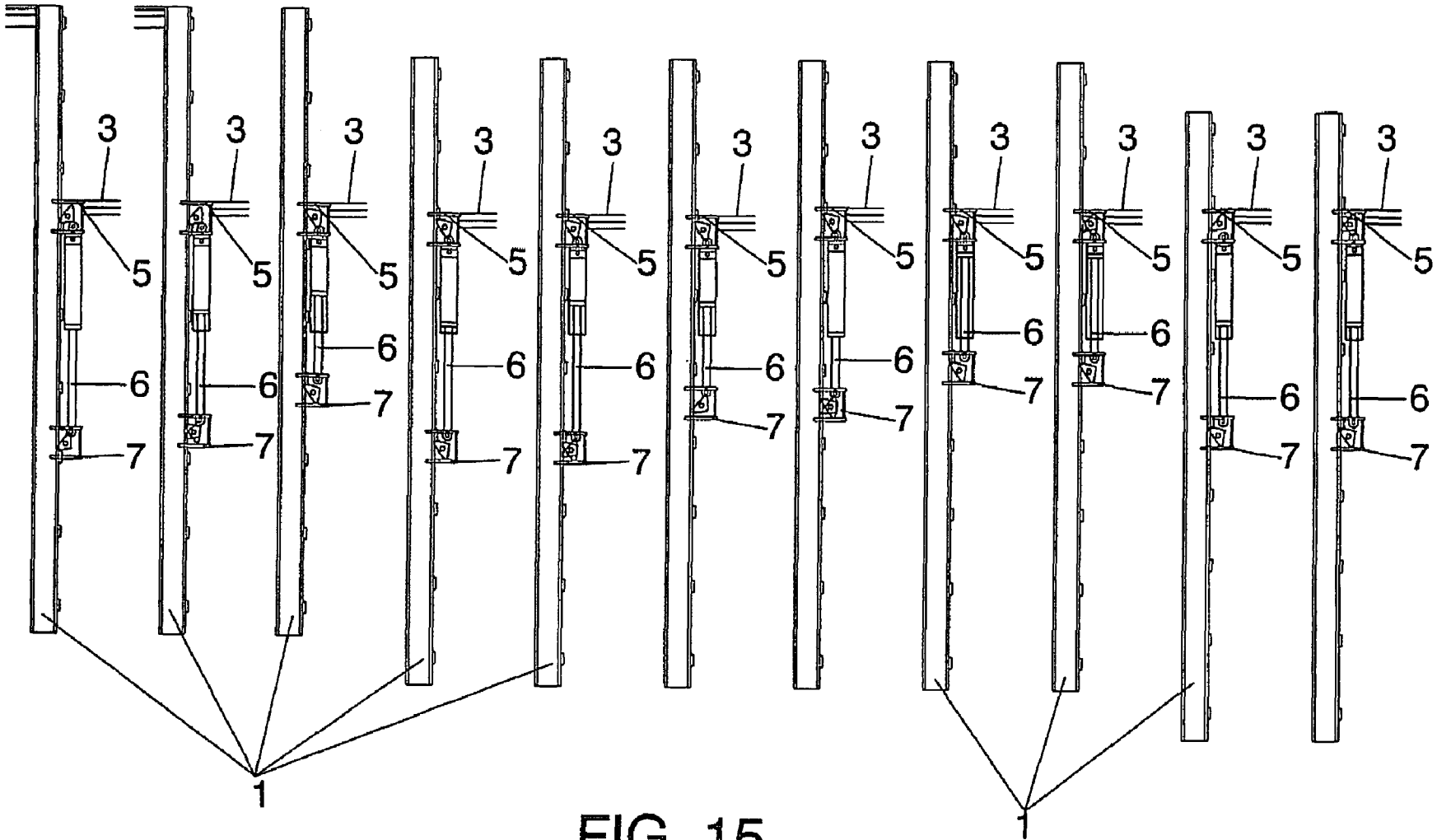
FIG. 15.—Is a side view corresponding to the sequence of descent of the upright.

The upright (1) is lowered following the sequence shown in FIG. 15, which involves the following phases:

a) The rocker of the lower head (7) is placed in the position for raising the upright and the cylinder (6) is retracted until said rocker (11) makes contact with one of the flanges (14) on the upright (1).

b) The upright (1) is unfastened from the wall (2), with the rocker of the upper head (5) in the position for raising the bracket arrangement.

c) The cylinder (6) begins to extend and therefore the upright (1) descends. The flanges (14) on the upright (1) can pass over the upper head (5) as their rocker (11) is in the position for raising the bracket arrangement.

d) Before the cylinder (6) extends completely, the rocker (11) of the upper head (5) is changed to the position for raising the upright so that it supports the upright (1). The extension of the cylinder (6) continues. When it reaches the end, the rocker (11) of the lower head (7) is changed to the position for raising the bracket arrangement in order to retract the cylinder (6) and pass a flange (14). Once the flange (14) has been passed, the rocker (11) of the lower head (7) must be changed back to the position for raising the bracket arrangement so that the rocker (11) is situated on the lower part of the following flange (14). Once the lower head is supporting the upright, the rocker (11) of the upper head is changed to the position for raising the bracket arrangement so that the flanges (14) can pass. Phases c) and d) are repeated until the upright reaches the next anchoring point on the wall.

Figure 16:
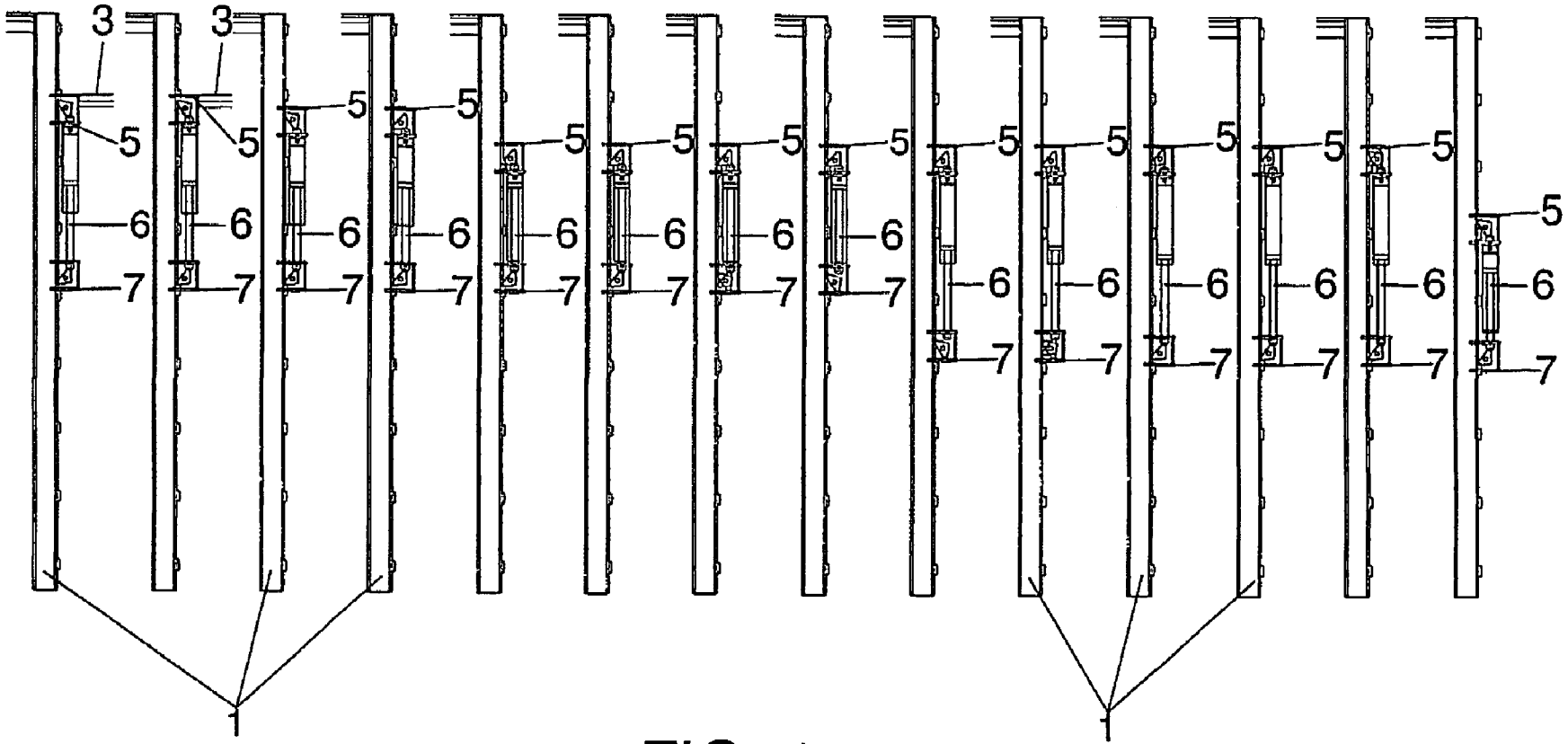
FIG. 16.—Is a side view corresponding to the sequence of descent of the bracket arrangement.

Then, the bracket arrangement (3) is lowered following the sequence shown in FIG. 16, which involves the following phases:

e) the rocker (11) of the lower head (7) is positioned in the position for raising the bracket arrangement and the cylinder (6) is retracted until it passes a flange (14) on the upright (1). The cylinder (6) then extends until the rocker (11) of the lower head (7) rests against a flange (14) on the upright (1). The upper head (5) remains in the position for raising the upright so that, on lowering the bracket arrangement (3), it passes over the flanges (14) on the upright (1), enabling the bracket arrangement (3) to be unfastened from the wall (2).

f) The cylinder (6) is retracted, with the bracket arrangement (3) resting on the upright (1) by means of the rocker (11) of the lower head (7), thus causing the bracket arrangement (3) to descend.

g) The position of the rocker (11) of the upper head (5) changes, while the cylinder (6) continues to descend.

h) The bracket arrangement (3) descends until the upper head (5) makes contact and rests against the next flange (14) on the upright (1).

i) Phases e) to i) are repeated, it being necessary to previously change the position of the rocker (11) of the lower head (7) to the position for raising the upright. At that moment, the bracket arrangement (3) is supported by the upper head (5). The cylinder (6) then extends for the rocker (11) of the upper head (5) to pass over the next flange (14) on the upright (1). The position of the rocker (11) of the lower head (7) is changed to the position for raising the bracket arrangement, the cylinder continuing to extend until the rocker (11) of the lower head (7) rests against the following flange (14) of the upright (1). The position of the rocker (11) of the upper head (5) is then changed to the position for raising the upright.

The invention claimed is:

1. A climbing system for shuttering, scaffolding and loads in general, comprising:

an upright adapted to be fixed to a wall or to move vertically in relation to the wall;

a bracket arrangement to be fixed to the wall or to move vertically in relation to the wall with a movement relative to the upright, said bracket arrangement having mounted thereon a shuttering structure for casting sections of the wall;

an upper head attached to the bracket arrangement and also solidly joined to a body portion of a hydraulic cylinder, the hydraulic cylinder including a rod; and a lower head attached to said rod of said hydraulic cylinder, each of said upper and said lower heads further comprising:

a body with upper and lower wings defining therebetween guides that encircle the upright, each of the heads having a rocker configured to act on flanges or blocks distributed along the upright, the rocker being mounted on a transversal axis, against the action of a spring that permanently acts on the rocker in any of rocker's operating positions;

a handle solidly joined to the transversal axis for rotating said axis to change the position of the rocker in relation to the upright, wherein the handle defines three operating positions for the rocker, including, (a) a position for raising the upright in which an upper face of the rocker is in a horizontal position and is adapted to push one of the flanges on the upright upwards to raise the upright, (b) a neutral position in which an inclined plane of the rocker is parallel to the upright and does not interact with the upright, and (c) a position for raising the bracket arrangement in which a lower face of the rocker is in a horizontal position and is adapted to rest on a flange on the upright to help raise the bracket arrangement; and a safety positioner limits the positions of the rocker, the safety positioner comprising: an inner disc that moves with a tilting movement of the rocker and that has a peripheral notch that defines a groove, which works with a spring positioner housed, depending on the operating position of the rocker, in one of three holes provided in an outer cover of the head, in such a way that the tilting movement of the rocker is limited when the spring positioner abuts against one of the edges of the groove in the inner disc and, specifically, (a) an upper hole into which the spring positioner is adapted to be inserted to define a position that limits the tilting movement of the rocker as the bracket arrangement is raised, (b) a lower hole into which the spring positioner is adapted to be inserted to define a position that limits the tilting movement of the rocker as the upright is raised, and (c) a central hole that defines a neutral position of the rocker, there being in a central area of the groove, a hole or recess that coincides in position with the central hole of the outer cover, into which the spring positioner is inserted, preventing the rocker from moving in either direction and thus securing the neutral position of the rocker.

2. The climbing system for shuttering, scaffolding and loads in general, according to claim 1, wherein the rocker has a practically triangular form with an inclined plane having two ends, the inclined plane being bevelled at its two ends, defining an upper face and an upper front face, at 90°, on one of its vertices and a lower face and a lower front face, also at 90°, on the other vertex, in such a way that on making contact with the flanges on the upright, the inclined plane, as it ascends or descends, tilts against the action of the spring, the inclined plane resuming its position once the inclined plane has passed over the flange, whilst the upper and lower faces constitute the active faces of the rocker, which transmit corresponding stresses to raise the upright and the bracket arrangement.

3. The climbing system for shuttering, scaffolding and loads in general according to the claim 2, wherein, during working phases in which the upright and the bracket arrangement are raised, the upper and lower front faces, respectively, remain in contact with the surface of the upright, preventing it from rotating and thus maintaining said operating positions.

4. A climbing system for shuttering, scaffolding and loads in general, comprising:

an upright adapted to be fixed to a wall or to move vertically in relation to the wall;

a bracket arrangement adapted to be fixed to the wall or to move vertically in relation to the wall with a movement relative to the upright, said bracket arrangement having mounted thereon a shuttering structure for casting sections of the wall;

an upper head attached to the bracket arrangement and also solidly joined to a body portion of a hydraulic cylinder, the hydraulic cylinder including a rod; and a lower head attached to said rod of said hydraulic cylinder, each of said upper and said lower heads further comprising:

a body with upper and lower wings defining therebetween guides that encircle the upright, each of the heads having a rocker configured to act on flanges or blocks distributed along the upright, the rocker being mounted on a transversal axis, against the action of a spring that permanently acts on the rocker in any of the rocker's operating positions;

a handle solidly joined to the transversal axis for rotating said axis to change the position of the rocker in relation to the upright, wherein the handle defines three operating positions for the rocker; and a safety positioner that limits positions of the rocker in the three operating positions.

5. The climbing system for shuttering, scaffolding and loads in general of claim 4, wherein the three operating positions include:

a position for raising the upright in which an upper face of the rocker is in a horizontal position and is adapted to push one of the flanges on the upright upwards to raise the upright;

a neutral position in which an inclined plane of the rocker is parallel to the upright and does not interact with the upright; and a position for raising the bracket arrangement in which a lower face of the rocker is in a horizontal position and is adapted to rest on a flange on the upright to help raise the bracket arrangement.

6. The climbing system for shuttering, scaffolding and loads in general of claim 4, wherein the safety positioner further comprises an inner disc that moves with a tilting movement of the rocker and which has a peripheral notch that defines a groove, which works with a spring positioner housed, depending on the operating position of the rocker, in one of three holes provided in an outer cover of the head, in such a way that the tilting movement of the rocker is limited when the spring positioner abuts against one of the edges of the groove in the inner disc and, specifically, (a) an upper hole into which the spring positioner is adapted to be inserted to define a position that limits the tilting movement of the rocker as the bracket arrangement is raised, (b) a lower hole into which the spring positioner is adapted to be inserted to define a position that limits the tilting movement of the rocker as the upright is raised, and (c) a central hole that defines a neutral position of the rocker, there being in a central area of the groove, a hole or recess that coincides in position with the central hole of the outer cover, into which the spring positioner is inserted, preventing the rocker from moving in either direction and thus securing the neutral position of the rocker.

* * * * *